US006458502B1

(12) United States Patent
Nakamura et al.

(10) Patent No.: US 6,458,502 B1
(45) Date of Patent: Oct. 1, 2002

(54) PROCESS FOR PRODUCING POLYMERIZATION TONER

(75) Inventors: Tatsuya Nakamura, Shizuoka; Hiroaki Kawakami; Koji Inaba, both of Kanagawa; Yuji Moriki, Shizuoka; Satoshi Handa, Shizuoka; Katsuyuki Nonaka, Shizuoka, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/875,012

(22) Filed: Jun. 7, 2001

(30) Foreign Application Priority Data

| | | |
|---|---|---|
| Jun. 8, 2000 | (JP) | 2000/171414 |
| Jun. 8, 2000 | (JP) | 2000/171415 |
| Jun. 8, 2000 | (JP) | 2000/171416 |
| Apr. 27, 2001 | (JP) | 2001/131068 |
| Apr. 27, 2001 | (JP) | 2001/131530 |
| Apr. 27, 2001 | (JP) | 2001/131531 |

(51) Int. Cl.[7] ..... G03G 9/087; G03G 9/093
(52) U.S. Cl. ..... 430/137.17; 430/137.15
(58) Field of Search ..... 430/137.17, 137.15

(56) References Cited

U.S. PATENT DOCUMENTS

| | | | | |
|---|---|---|---|---|
| 4,578,338 A | | 3/1986 | Gruber et al. | 430/120 |
| 4,810,612 A | | 3/1989 | Ueda et al. | 430/109 |
| 4,816,366 A | | 3/1989 | Hyosu et al. | 430/137 |
| 4,990,424 A | | 2/1991 | Van Dusen et al. | 430/106.6 |
| 5,300,386 A | | 4/1994 | Kanbayashi et al. | 430/99 |
| 5,354,640 A | | 10/1994 | Kanbayashi et al. | 430/110 |
| 5,476,745 A | | 12/1995 | Nakamura et al. | 430/137 |
| 5,571,653 A | | 11/1996 | Kasuya et al. | 430/109 |
| 5,665,833 A | * | 9/1997 | Mukaiyama et al. | 526/88 |
| 5,968,705 A | * | 10/1999 | Yamada et al. | 430/137.17 |
| 6,207,339 B1 | | 3/2001 | Kato et al. | 430/137 |

FOREIGN PATENT DOCUMENTS

| | | |
|---|---|---|
| EP | 0470479 | 2/1992 |
| EP | 0651293 | 5/1995 |
| EP | 100308 | 5/2000 |
| JP | 36 10231 | 7/1961 |
| JP | 43 10799 | 5/1968 |
| JP | 52 3304 | 1/1977 |
| JP | 52 3305 | 1/1977 |
| JP | 60 217366 | 10/1985 |
| JP | 60 252360 | 12/1985 |
| JP | 60 252361 | 12/1985 |
| JP | 61 94062 | 5/1986 |
| JP | 61 138259 | 6/1986 |
| JP | 61 273554 | 12/1986 |
| JP | 62 14166 | 1/1987 |
| JP | 1 109359 | 4/1989 |
| JP | 2 79860 | 3/1990 |
| JP | 3 50559 | 3/1991 |
| JP | 5 341573 | 12/1993 |
| JP | 7 82248 | 3/1995 |

* cited by examiner

*Primary Examiner*—John Goodrow
(74) *Attorney, Agent, or Firm*—Fitzpatrick, Cella, Harper & Scinto

(57) ABSTRACT

A process for producing a polymerization toner, which comprises preparing a polymerizable-monomer composition which contains at least a polymerizable monomer and a colorant and does not contain any polymerization initiator, i) introducing the polymerizable-monomer composition into an aqueous medium to effect granulation, adding a polymerization initiator to the aqueous medium in the course of the granulation or after the granulation has been completed, or ii) adding a polymerization initiator in an aqueous medium, introducing the polymerizable-monomer composition into the aqueous medium to effect granulation, and then polymerizing the polymerizable-monomer composition having been granulated, to produce toner particles. In the process, the polymerization initiator is added in a specific time and a specific manner.

57 Claims, 6 Drawing Sheets

CROSS SECTIONS OF TONER PARTICLES

PROCESS FOR PRODUCING POLYMERIZATION TONER

BACKGROUND OF THE INVENTION

1. Field of the Invention

This invention relates to a process for producing a polymerization toner used in, e.g., electrophotography, electrostatic recording, magnetic recording and toner jet recording.

2. Related Background Art

A number of methods are conventionally known as electrophotography. In general, copied images are obtained by forming an electrostatic latent image on a photosensitive member by utilizing a photoconductive material and by various means, subsequently developing the latent image by the use of a toner to form a toner image, and transferring the toner image to a transfer medium such as paper as occasion calls, followed by fixing by the action of heat and/or pressure. As methods for developing electrostatic latent images by the use of toners or methods for fixing toner images, a variety of methods have been proposed.

Toners used for such purpose have commonly been produced by melt-kneading colorants such as dyes and/or pigments into thermoplastic resins to effect dispersion uniformly, followed by pulverization by means of a fine grinding mill and then classification of the pulverized product to produce toners having the desired particle diameters.

Reasonably good toners can be produced by such a production method, but there is a certain limit, i.e., a limit to the range in which toner materials are selected. For example, resin-colorant dispersions must be brittle enough to be pulverizable by means of economically available production apparatus. However, resin-colorant dispersions made brittle in order to meet these requirement tend to result in a broad particle size range of the particles formed when actually pulverized at a high speed, especially causing the problem that fine particles tend to be included in the particles in a relatively large proportion. Moreover, such highly brittle materials tend to be further pulverized or powdered when used in development in, e.g., copying machines.

In this method, it is also difficult to perfectly uniformly disperse solid fine particles of colorants or the like in the resin, and, depending on the degree of their dispersion, toners may cause an increase in fog, a decrease in image density and a lowering of color mixing properties or transparency when images are formed. Accordingly, care must well be taken when colorants are dispersed. Also, colorants may come bare to rupture sections of toner particles, and may cause fluctuations in developing performance of toners.

Meanwhile, in order to overcome the problems of the toners produced by such pulverization, various polymerization toners and methods of producing such toners are proposed, including toners produced by suspension polymerization as disclosed in Japanese Patent Publications No. 36-10231, No. 43-10799 and No. 51-14895. For example, in the suspension polymerization, a polymerizable monomer, a colorant and a polymerization initiator, and also optionally a cross-linking agent, a charge control agent and other additives are uniformly dissolved or dispersed to form a monomer composition. Thereafter, this monomer composition is dispersed in a continuous phase, e.g., an aqueous phase, containing a dispersion stabilizer, by means of a suitable agitator, and is simultaneously subjected to polymerization to obtain toner particles having the desired particle diameters.

Since this method has no step of pulverization at all, the toner particles are not required to be brittle, and hence soft materials can be used. Also, colorants by no means come bare to the surfaces of toner particles, and hence the toner can have a uniform triboelectric charging performance. This method has such advantages. Also, since the toner obtained has a relatively sharp particle size distribution, the step of classification can be omitted, or even when classification is carried out, the toner can be obtained in a high yield.

In order to cause no toners to adhere to the surface of the fixing roller, a measure has also been hitherto taken such that the roller surface is formed of a material such as silicon rubber or fluorine resin, having an excellent releasability to toner, and, in order to prevent offset and to prevent fatigue of the roller surface, its surface is further covered with a thin film formed using a fluid having a high releasability as exemplified by silicone oil or fluorine oil. However, this method, though very effective in view of the prevention of the offset of toner, requires a device for feeding an anti-offset fluid, and hence as a matter of course has the problem such that the fixing assembly must be complicated complicated. Also, this application of oil is involved in the difficulty that it causes separation of layers constituting the fixing roller to consequently acceleratedly shorten the lifetime of the fixing roller.

Accordingly, based on the idea that the fluid for preventing offset should be fed from the interiors of toner particles at the time of heat fixing without use of, e.g., any device for feeding silicone oil, a method has been proposed in which a release agent such as a low-molecular weight polyethylene or a low-molecular weight polypropylene is incorporated into toner particles.

It is known that a wax is incorporated as a release agent into toner particles. For example, this is disclosed in Japanese Patent Publications No. 52-3304 and No. 52-3305 and Japanese Patent Application Laid-open No. 57-52574.

Japanese Patent Applications Laid-open No. 3-50559, No. 2-79860, No. 1-109359, No. 62-14166, No. 61-273554, No. 61-94062, No. 61-138259, No. 60-252361, No. 60-252360 and No. 60-217366 disclose incorporation of waxes in toners.

Waxes are used for the purpose of improving anti-offset properties at the time of low-temperature fixing or high-temperature fixing of toners or improving fixing performance at the time of low-temperature fixing, but on the other hand tend to cause a lowering of anti-blocking properties of toners, a lowering of developing performance because of temperature rise in copying machines, or a lowering of developing performance because of migration of wax toward toner particle surfaces when toners are left for a long term.

As a countermeasure for the above problems, toners produced by suspension polymerization are proposed. For example, according to the disclosure in Japanese Patent Application Laid-open No. 5-341573, a polar component is added to a monomer composition, where components having polar groups, contained in the monomer composition, tend to become present at surface layer portions which are interfaces with the aqueous phase and non-polar components do not tend to become present at the surface layer portions, and hence toner particles can have core/shell structure.

In the toner produced by suspension polymerization, the wax is encapsulated in toner particles. This enables achievement of both the anti-blocking properties and the high-temperature anti-offset properties that conflict with each other, and also enables prevention of high-temperature offset without applying any release agent such as oil to fixing rollers.

As also disclosed in Japanese Patent Publications No. 7-82248 and No. 7-120072, as a production process intended to improve fixing performance of polymerization toners, it is proposed to effect granulation of a monomer composition in an aqueous medium and thereafter add a polymerization initiator to the aqueous medium to carry out suspension polymerization. This method makes it possible to make toner particles spherical, make them have a sharp particle size distribution and also incorporate therein the wax in a large quantity.

As still also disclosed in Japanese Patent Application Laid-open No. 10-239900, it is proposed to disperse a monomer composition in an aqueous medium and thereafter add a polymerization initiator to the aqueous medium, followed by further dispersion to prepare droplets to carry out suspension polymerization.

In addition, it has become popular to use copying machines or printers for forming full-color images.

In the case of fixing assemblies in full-color image-forming apparatus, a plurality of toner layers corresponding to magenta toner, cyan toner, yellow toner and black toner are formed on a transfer medium, and hence the offset tends to occur because of toner layers formed in large thickness.

As transfer mediums on which toner images are fixed, paper of various types, coated paper, plastic films and so forth are commonly used. In particular, a need for transparency films (OHP films) has increased, which make use of an overhead projector for its presentation. Especially in OHP films, as different from paper, a large quantity of oil is present on the OHP film surface after fixing, because of their low oil absorption capacity. Silicone oil may evaporate by heat to contaminate the interior of image forming apparatus, and also has the problem of disposal of recovered oil.

However, taking account of the recent demand for small size, light weight and high reliability, it is preferable also in the full-color image-forming apparatus to omit even such a supplementary device.

In order to improve color-mixing performance of toners and also provide toners having superior low-temperature fixing performance, it is preferable for binder resins to melt instantaneously at the time of fixing. However, binder resins having such properties on the one hand may on the other hand necessarily have poor high-temperature anti-offset properties, anti-blocking properties and running performance.

SUMMARY OF THE INVENTION

An object of the present invention is to provide a process for producing a polymerization toner which can meet the requirements stated above.

Another object of the present invention is to provide a process for producing a polymerization toner having a superior fixing performance.

Still another object of the present invention is to provide a process for producing a polymerization toner having a superior continuous productivity.

A further object of the present invention is to provide a process for producing a polymerization toner promising a good charge quantity and having superior developing performance (toner charge quantity, image density) and transfer performance even in many-sheet running.

The present invention provides a process for producing a polymerization toner, which comprises preparing a polymerizable-monomer composition which contains at least a polymerizable monomer and a colorant and does not contain any polymerization initiator, introducing the polymerizable-monomer composition into an aqueous medium to start granulation, adding a polymerization initiator to the aqueous medium in the course of the granulation, and then polymerizing the polymerizable-monomer composition having been granulated, to produce toner particles;

the polymerization initiator being added to the aqueous medium over a period of from 5 seconds to 300 seconds, and the time T (second) taken to add the polymerization initiator and the number N of pass times per unit time (times/second) of a stirring blade used in the granulation satisfying the relationship of:

$$3 \leqq T \times N \leqq 500.$$

In another embodiment, the present invention provides a process for producing a polymerization toner, which comprises preparing a polymerizable-monomer composition which contains at least a polymerizable monomer and a colorant and does not contain any polymerization initiator, introducing the polymerizable-monomer composition into an aqueous medium to effect granulation, adding a polymerization initiator to the aqueous medium after the granulation has been completed, and then polymerizing the polymerizable-monomer composition having been granulated, to produce toner particles;

the polymerization initiator being added to the aqueous medium over a period of from 5 seconds to 300 seconds, and the time T (second) taken to add the polymerization initiator and the number N of pass times per unit time (times/second) of a stirring blade used in the reaction satisfying the relationship of:

$$5 \leqq T \times N \leqq 2{,}500.$$

In still another embodiment, the present invention provides a process for producing a polymerization toner, which comprises preparing a polymerizable-monomer composition which contains at least a polymerizable monomer and a colorant and does not contain any polymerization initiator, adding a polymerization initiator to an aqueous medium, introducing the polymerizable-monomer composition into the aqueous medium to effect granulation, and then polymerizing the polymerizable-monomer composition having been granulated, to produce toner particles;

the polymerizable-monomer composition being introduced into the aqueous medium within 10 minutes after the polymerization initiator has been added, and the time T (second) taken to add the polymerization initiator being:

$$5.0 \times 10^{-5} \leqq T/t_{1/2} \leqq 1.0 \times 10^{-2}$$

where $t_{1/2}$ is the half-life period of the polymerization initiator at granulation temperature.

DETAILED DESCRIPTION OF THE PREFERRED EMBODIMENTS

Figure 1:
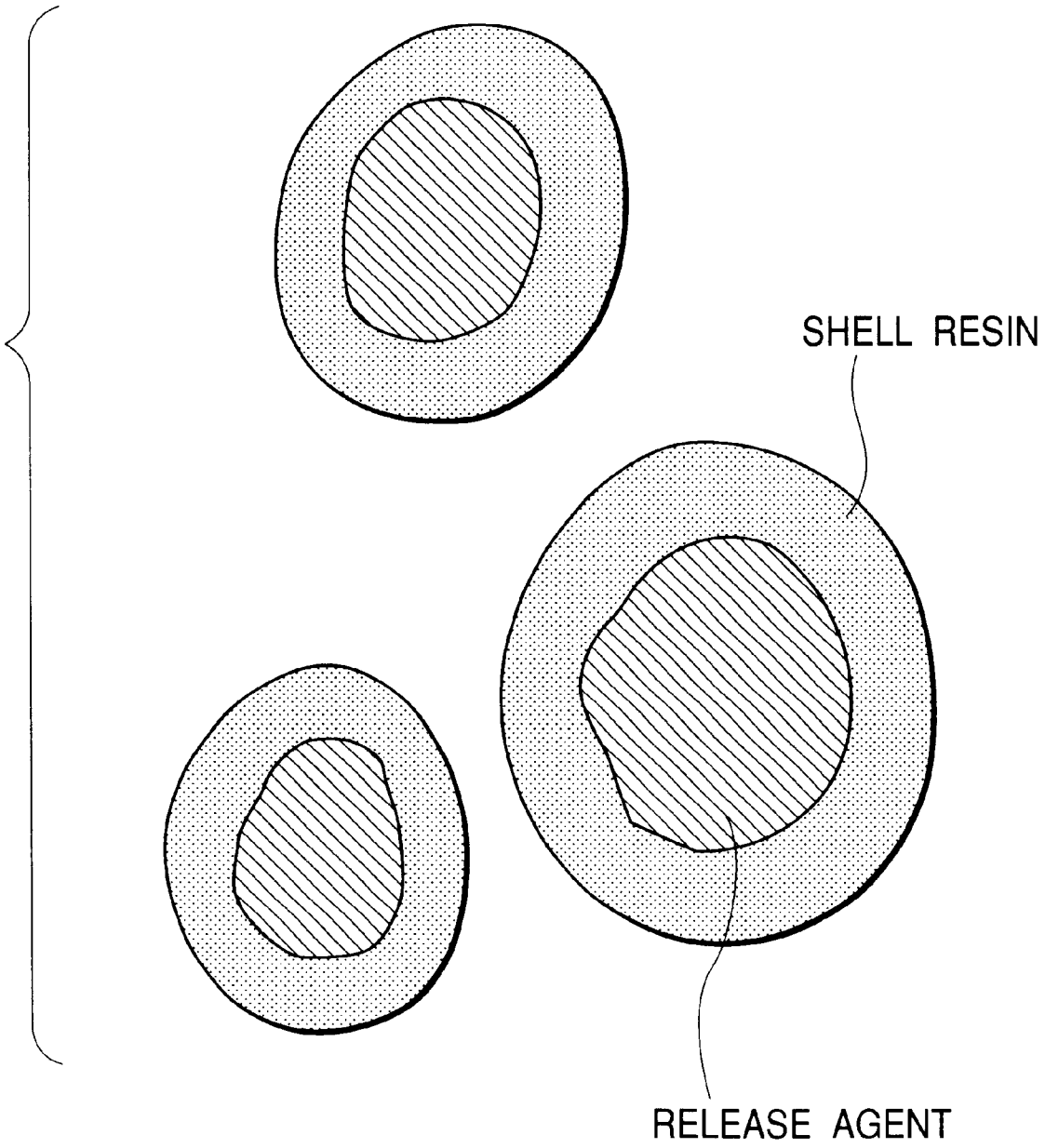
FIG. 1 is a diagrammatic view of cross sections of toner particles in which a release agent stands encapsulated with a shell resin.

In the disclosure in Japanese Patent Publication No. 7-120072 and Japanese Patent Application Laid-open No. 10-239900, the polymerization initiator is added in the course of granulation or after the granulation. However, the present inventors have discovered that the performance of polymerization toners is more improved by designing the manner of adding the polymerization initiator, thus they have accomplished the present invention.

Compared with a case in which the polymerization initiator is incorporated in a polymerizable-monomer composition, or a case in which the polymerization initiator is merely added in the course of granulation or after the granulation, i.e., a case in which the polymerization initiator is added to an aqueous medium within less than 5 seconds in the course of granulation or after the granulation, the polymerization initiator is more uniformly fed into individual particles of the polymerizable-monomer composition in a case in which 1) the polymerization initiator is added to an aqueous medium over a period of from 5 to 300 seconds in the course of granulation or after the granulation or 2) the polymerizable-monomer composition is introduced into the aqueous medium within 10 minutes after the polymerization initiator has been added. Hence, the toner can have sharp molecular-weight distribution between toner particles, and a toner having sharp heat fusion properties and good fixing performance can be obtained. In addition, the toner can have good fluidity and also superior developing performance and transfer performance, thus a toner can be obtained which may hardly cause its melt adhesion to carriers, sleeves and blades and has superior running performance.

A first embodiment of the present invention is described below.

In the first embodiment of the present invention, the polymerization initiator is added to an aqueous medium in the course of granulation, where the polymerization initiator is added to the aqueous medium over a period of from 5 seconds to 300 seconds, and the time T (second) taken to add the polymerization initiator and the number N of pass times per unit time (times/second) of a stirring blade used in the granulation satisfy the relationship of:

$$3 \leqq T \times N \leqq 500.$$

The addition of the polymerization initiator in the aqueous medium over a period of from 5 seconds to 300 seconds as stated above enables the polymerization initiator to be uniformly fed into individual particles of the polymerizable-monomer composition. Hence, the toner has sharp molecular-weight distribution between toner particles. The time taken to add the polymerization initiator may more preferably be from 10 to 250 seconds, and particularly preferably from 10 to 180 seconds.

Here, in the first embodiment and following second and third embodiments of the present invention, the time of point where the polymerization initiator has been added by 90% by weight of the whole initiator to be added is regarded as the time taken to add the polymerization initiator. In suspension polymerization, the polymerization initiator is used in excess in order to, e.g., reduce the quantity of any residual monomers, or, in some cases, the polymerization initiator is separately added in a small quantity at the latter half stage of polymerization. In such cases, too, the present invention can be effective as long as the polymerization initiator has been added by 90% by weight of the whole initiator over a period of from 5 seconds to 300 seconds.

If the time taken to add the polymerization initiator is longer than 300 seconds, the polymerization initiator is uniformly fed into the individual particles of the polymerizable-monomer composition but the time for its addition is so long that the molecular-weight distribution of the toner may be controlled with difficulty, because the polymerization reaction has already been initiated in part. As the result, no good fixing performance may be attained.

It is also required that the time T (second) taken to add the polymerization initiator and the number N of pass times per unit time (times/second) of a stirring blade used in the granulation satisfy the relationship of:

$$3 \leqq T \times N \leqq 500.$$

The above T and N may further preferably satisfy the relationship of:

$$8 \leqq T \times N \leqq 250.$$

Here, the "the number of pass times per unit time" is the value found when the throughput per unit time of a stirring blade used in the granulation is divided by the total weight of the aqueous medium and the polymerizable-monomer composition put together.

If the product of T and N is less than 3, the throughput of the stirring blade is so small and/or the time taken to add the polymerization initiator is so short that the polymerization initiator added at some part in the aqueous medium may come to tend to stagnate, so that it may become hard for the polymerization initiator to be uniformly fed into individual particles of the polymerizable-monomer composition, resulting in a broad molecular-weight distribution between particles. If on the other hand the product of T and N is more than 500, the throughput of the stirring blade is so large and/or the time taken to add the polymerization initiator is so long that, although the polymerization initiator is uniformly fed into individual particles of the polymerizable-monomer composition, fine particles tend to be formed in a large quantity, resulting in a broad molecular-weight distribution in this case, too.

In the first embodiment of the present invention, the polymerization initiator may preferably be added at the time the particles of the polymerizable-monomer composition dispersed in the aqueous medium (dispersion medium) have a particle diameter of 1,000% to 105% based on the particle diameter of particles formed when the granulation is completed.

Since the polymerization initiator is added in the timing described above, the polymerization initiator can be fed into individual particles, keeping fine particles from being formed. Hence, the toner particles can have sharp molecular-weight distribution and sharp particle size distribution. More specifically, if the polymerization initiator is added earlier than the above timing, it comes to be added at a stage where the particles are still fairly large. Hence, the particles may undergo shear force to come to have the desired particle diameter before the polymerization initiator is uniformly dissolved or dispersed into the particles, so that the polymerization initiator tends to be in a concentration which is non-uniform between particles. If on the other hand the polymerization initiator is added later than the above timing, it comes to be added at a stage where the particles have a diameter close to the desired particle diameter. Hence, any attempt to exert shear force until the polymerization initiator has uniformly been absorbed into particles tends to result in an increase in fine particles. Also, though the reason is unclear, there is seen a tendency of improvement also in resistance to contamination of vessels, bringing about a higher continuous productivity.

The particle diameter of the particles of the polymerizable-monomer composition dispersed in the dispersion medium may be measured in the following way: The dispersion medium containing particles of the polymerizable-monomer composition is sampled from the granulation vessel, and the particles contained in the sampled dispersion medium is magnified 500 times on an optical microscope to measure their lengths. This measurement is made on 100 particles, and their average value is regarded as the particle diameter.

A second embodiment of the present invention is described below.

In the second embodiment of the present invention, the polymerization initiator is added to an aqueous medium after the granulation has been completed, where the polymerization initiator is added to the aqueous medium over a period of from 5 seconds to 300 seconds, and the time T (second) taken to add the polymerization initiator and the number N of pass times per unit time (times/second) of a stirring blade used in the reaction satisfy the relationship of:

$$5 \leqq T \times N \leqq 2{,}500.$$

The second embodiment of the present invention is the same as the first embodiment of the present invention in respect of the addition of the polymerization initiator in the aqueous medium over a period of from 5 seconds to 300 seconds (preferably from 10 seconds to 250 seconds, particularly preferably from 10 seconds to 180 seconds).

Since, however, in the second embodiment of the present invention the polymerization initiator is added after the granulation has been completed, it is important to feed the polymerization initiator uniformly to individual particles while keeping the particle size distribution of granulated particles. Thus, the product of the time T (second) taken to add the polymerization initiator and the number N of pass times per unit time (times/second) of a stirring blade used in the reaction is given in the greater range of numerical values than that in the case of the first embodiment of the present invention, where a superior effect is obtainable.

In the second embodiment of the present invention, the above T and N may further preferably satisfy the relationship of:

$$10 \leqq T \times N \leqq 2{,}000.$$

If the product of T and N is less than 5, the throughput of the stirring blade is so small and/or the time taken to add the polymerization initiator is so short that the polymerization initiator added at some part in the aqueous medium may come to tend to stagnate, so that it may become hard for the polymerization initiator to be uniformly fed into individual particles of the polymerizable-monomer composition, resulting in a broad molecular-weight distribution between particles. If on the other hand the product of T and N is more than 2,500, the throughput of the stirring blade is so large and/or the time taken to add the polymerization initiator is so long that, although the polymerization initiator is uniformly fed into individual particles of the polymerizable-monomer composition, fine particles tend to be formed in a large quantity, resulting in a broad molecular-weight distribution in this case, too.

In the above first and second embodiments of the present invention, the polymerization initiator is not incorporated in the polymerizable-monomer composition, and hence the vessel where the polymerizable-monomer composition is prepared can be well kept from being contaminated. Moreover, the polymerization initiator is not added at one time, but added little by little, thus the polymerization initiator is freshly added while the polymerization initiator having been added is being consumed, and hence stable polymerization takes place, so that the vessels where the granulation and reaction are carried out can be kept cleaner. Where the polymerization initiator is added at one time, the polymerization initiator may stand in a high concentration in the vicinity of the port from which the polymerization initiator is introduced, so that the polymer may adhere to the vessel's wall vicinal to that port to cause contamination. On the other hand, in the first and second embodiments of the present invention, which is operated as described above, the continuous productivity for a good polymerization toner can be attained.

A third embodiment of the present invention is described below.

In the third embodiment of the present invention, the polymerization initiator is added before the granulation, stated in other words, before the polymerizable-monomer composition is added to the aqueous medium. The time at which the polymerizable-monomer composition is introduced must be within 10 minutes after the polymerization initiator has been added to the aqueous medium. If the time at which the polymerizable-monomer composition is introduced is longer than 10 minutes after the polymerization initiator has been added to the aqueous medium, the decomposition reaction of the polymerization initiator may proceed too much before the polymerizable-monomer composition is introduced, making it difficult to control the molecular-weight distribution of the toner. As the result, no good fixing performance may be attained. Taking account of dispersing the polymerization initiator, the polymerizable-monomer composition may more preferably be introduced at a time of from 1 minute to 8 minutes after the polymerization initiator has been added. If it is added earlier than 1 minute after that, the polymerization initiator may insufficiently be dispersed in the aqueous medium to tend to make it difficult to obtain a toner having uniform molecular-weight distribution.

It has also been found that the polymerization toner production process as in the third embodiment of the present invention has a superior continuous productivity for the polymerization toner, because the vessels in which the granulation and reaction are carried out can be kept cleaner than the polymerization process in which the polymerization initiator is added at one time in the course of granulation or after the granulation. Any detailed mechanism is unknown at present. It is presumed that the particles formed by adding the polymerization initiator in the aqueous medium and thereafter introducing the polymerizable-monomer composition into the aqueous medium to effect granulation have structure or properties such that they act advantageously for anti-adhesion performance.

In the third embodiment of the present invention, the time T (second) taken to add the polymerization initiator satisfy the relationship of:

$$5.0 \times 10^{-5} \leqq T/t_{1/2} \leqq 1.0 \times 10^{-2}$$

where $t_{1/2}$ is the half-life period of the polymerization initiator at granulation temperature.

The above T may preferably satisfy the relationship of:

$$1.0\times10^{-4}\leqq T/t_{1/2}\leqq1.0\times10^{-2}.$$

If the value of $T/t_{1/2}$ is smaller than $5.0\times10^{-5}$, the polymerizable-monomer composition may come to have a broad molecular-weight distribution to make molecular-weight control difficult. This is not preferable for the production of the toner. As the cause thereof, it is presumed that, where the time taken to add the polymerization initiator is too short for its half-life period, the time during which the polymerization initiator is uniformly dispersed in the aqueous medium and the time by which the polymerization initiator having been added comes to have a uniform temperature may ill-balance to cause a difference in reactivity between the vicinity of interface of polymerization initiator/aqueous medium and the centers of initiator droplets, so that the polymerization toner may come to have a broad molecular-weight distribution or it becomes difficult to control the molecular weight because of a poor initiator efficiency. If the value of $T/t_{1/2}$ is larger than $1.0\times10^{-2}$, the molecular-weight distribution at the time the reaction has been completed tends to become broad because of a difference in progress of decomposition reaction between the reaction immediately after addition and the reaction upon completion of the addition, especially in a case in which the initiator has been dissolved in the monomer. Thus, such a value is also not preferable.

In the first to third embodiments of the present invention, the polymerization initiator may preferably be added in the form of a liquid. This is because the polymerization initiator added can readily be absorbed in the polymerizable-monomer composition. As methods for its addition in the form of a liquid, where the polymerization initiator is a solid, it may be added in the state it has been dissolved in a solvent capable of dissolving it or in the monomer. Where the polymerization initiator is a liquid, it may be added as it is or, like the above, may be added in the state it has been dissolved in a solvent capable of dissolving it or in the monomer.

Materials constituting the polymerization toner are described below.

As the polymerizable monomer used in the polymerization toner production process of the present invention, usable are vinyl type polymerizable monomers capable of radical polymerization. As the vinyl type polymerizable monomers, monofunctional polymerizable monomers or polyfunctional polymerizable monomers may be used.

The monofunctional polymerizable monomers may include styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene; acrylate type polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate and 2-benzoyloxy ethyl acrylate; methacrylate type polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate and dibutyl phosphate ethyl methacrylate; methylene aliphatic monocarboxylates; vinyl esters such as vinyl acetate, vinyl propionate, vinyl butyrate, vinyl benzoate and vinyl formate; vinyl ethers such as methyl vinyl ether, ethyl vinyl ether and isobutyl vinyl ether; and vinyl ketones such as methyl vinyl ketone, hexyl vinyl ketone and isopropyl vinyl ketone.

The polyfunctional polymerizable monomers may include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis[4-(acryloxy•diethoxy)phenyl]propane, trimethyrolpropane triacrylate, tetramethyrolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis[4-(methacryloxy•diethoxy)phenyl]propane, 2,2'-bis[4-(methacryloxy polyethoxy)phenyl]propane, trimethyrolpropane trimethacrylate, tetramethyrolmethane tetramethacrylate, divinyl benzene, divinyl naphthalene, and divinyl ether.

Any of these may be used alone, or usually used in the form of an appropriate mixture of monomers so mixed that the theoretical glass transition temperature (Tg) as described in a publication POLYMER HANDBOOK, 2nd Edition III, pp.139–192 (John Wiley & Sons, Inc.) ranges from 40 to 75° C. If the theoretical glass transition temperature is lower than 40° C., problems may arise in respect of storage stability of toners or running stability of developers. If on the other hand it is higher than 75° C., the fixing point of the toner may become higher. Especially in the case of full-color toners, the color mixing performance of the respective color toners at the time of fixing may lower, resulting in a poor color reproducibility, and also the transparency of OHP images may greatly lower. Thus, such temperatures are not preferable.

Molecular weight of the toner is measured by GPC (gel permeation chromatography). As a specific method for measurement by GPC, the toner is beforehand extracted with a toluene solvent for 20 hours by means of a Soxhlet extractor, and thereafter the toluene is evaporated by means of a rotary evaporator, followed by addition of an organic solvent capable of dissolving a low-softening substance but dissolving no shell resin, e.g., chloroform, to thoroughly carry out washing. Thereafter, the solution is dissolved in THF (tetrahydrofuran), and then filtered with a solvent-resistant membrane filter of 0.3 μm in pore diameter to obtain a sample. Molecular weight of the sample is measured using a detector 150C., manufactured by Waters Co. As column constitution, A-801, A-802, A-803, A-804, A-805, A-806 and A-807, available from Showa Denko K.K., are connected, and molecular-weight distribution can be measured using a calibration curve of a standard polystyrene resin.

As the polymerization initiator used when the above polymerizable monomer is polymerized, an oil-soluble initiator may preferably be used. For example, the oil-soluble initiator may include azo compounds such as 2,2'-azobisisobutyronitrile, 2,2'-azobis-(2,4-dimethylvaleronitrile), 1,1'-azobis-(cyclohexane-1-carbonitrile), and 2,2'-azobis-4-methoxy-2,4-dimethylvaleronitrile; and peroxide type initiators such as acetylcyclohexylsulfonyl peroxide, diisopropylperoxy carbonate, decanonyl peroxide, lauroyl peroxide, stearoyl peroxide, propionyl peroxide, acetyl peroxide, t-butylperoxy-2-ethylhexanoate, benzoyl peroxide, t-butylperoxyisobutyrate, cyclohexanone peroxide, methyl ethyl ketone peroxide, dicumyl peroxide, t-butyl hydroperoxide, di-t-butyl hydroperoxide, and cumene hydroperoxide.

In order to control the degree of polymerization, any cross-linking agent, chain transfer agent and polymerization inhibitor may further be added and used.

The cross-linking agent used in the present invention may include divinylbenzene, ethylene glycol diacrylate, ethylene glycol dimethacrylate, 1,3-butane diol dimethacrylate, triethylene glycol diacrylate, tetraethylene glycol diacrylate, polyethylene glycol diacrylate, 1,6-hexanediol diacrylate, neopentyl glycol diacrylate, tripolyethylene glycol diacrylate, and polypropylene glycol diacrylate. Any of these cross-linking agents may be used in combination.

The cross-linking agent may preferably be added in an amount of from 0.01 to 5 parts by weight based on 100 parts by weight of the polymerizable monomer. If it is in an amount less than 0.01 part by weight, the running performance may be damaged. If on the other hand it is in an amount more than 5 parts by weight, poor low-temperature fixing performance and OHP sheet transparency may result undesirably.

In the present invention, as a polar resin, any of copolymer of styrene with acrylic or methacrylic acid, maleic acid copolymers, saturated polyester resins and epoxy resins may preferably be used. Of these polar resins, polyester resins are particularly preferred. The use of such a polar resin makes it possible to well obtain a toner having core/shell structure in which a wax is encapsulated in toner particles. This is because the toner is produced in an aqueous medium and hence the wax, which has a lower polarity than the polar resin, is forced into toner particles.

The polar resin may also preferably have an acid value of from 1 to 35 mg·KOH/g. Since the toner is obtained by polymerization in an aqueous medium, the polar resin is readily localized to toner particle surfaces. It is considered that, where the polar resin has the acid value of from 1 to 35 mg·KOH/g, it is readily localized to the vicinity of toner particle surfaces and hence a surface strength is attained which is high enough not to damage the low-temperature fixing performance.

If it has an acid value lower than 1 mg·KOH/g, the polar resin may become present in the vicinity of toner particle surfaces with difficulty, and any good charging performance may be attained with difficulty. If on the other hand it has an acid value higher than 35 mg·KOH/g, the polymerization initiator added in the course of granulation may undesirably be incorporated into toner particles with difficulty.

The acid value is determined in the following way.

In a 200 to 300 ml Erlenmeyer flask, 2 to 10 g of a resin sample is weighed and put, followed by addition of about 50 ml of a 30:70 mixed solvent of methanol and toluene to dissolve the resin. If it can not well be dissolved, acetone may be added in a small quantity. Using a 0.1% by weight mixed indicator of Bromothymol Blue and Phenol Red, titration is made with 0.1 mol/liter of a potassium hydroxide-alcohol (alcoholic potash) solution previously standardized, and the acid value is calculated from the consumption of the alcoholic potash solution according to the following equation. In the present invention, the average value of measurements found twice is employed.

$$A=(B\times f\times 5.611)/S$$

where;

A is the acid value (mg·KOH/g);

B is the amount (ml) of the 0.1 mol/liter potassium hydroxide alcohol solution used;

f is the factor of the 0.1 mol/liter potassium hydroxide ethyl alcohol solution used; and S is the sample (g).

The polar resin may preferably be added in an amount of from 0.1 to 50 parts by weight based on 100 parts by weight of the polymerizable monomer. As mentioned above, the addition of the polar resin makes it possible to obtain the toner having core/shell structure in which a wax, which is a low-softening substance and is also a release agent, is encapsulated in toner particles. This is because the toner is produced in an aqueous medium and hence the polar resin tends to become present at particle surfaces and the wax is forced into toner particles. If the polar resin is added in an amount less than 0.1 part by weight, it may be difficult for the wax to be encapsulated into particles and the wax may become present in the vicinity of toner particle surfaces in a high probability, so that the toner may have low developing performance and charging performance. Also, if it is contained in an amount more than 50 parts by weight, the polymerizable-monomer composition may increase in viscosity to make it difficult to obtain toner particles having small particle diameter and also uniform particle size distribution.

The polar resin may further preferably have a main-peak molecular weight Mp of from 5,000 to 50,000. If it has an Mp less than 5,000, the running performance of the toner may be damaged. If it has an Mp more than 50,000, it may take much time to dissolve condensation type compounds in the polymerizable monomer.

In the case of the present invention, the toner may also preferably have, as the molecular-weight distribution of its THF (tetrahydrofuran)-soluble matter, a main-peak molecular weight Mp of from 5,000 to 50,000 and a weight-average molecular weight Mw of from 50,000 to 1,000,000.

If the toner has a main-peak molecular weight Mp less than 5,000 or has a weight-average molecular weight Mw less than 50,000, it tends to have a poor running performance. If on the other hand the toner has a main-peak molecular weight Mp more than 50,000 or has a weight-average molecular weight Mw more than 1,000,000, it tends to have a poor fixing performance.

The polymerization toner may preferably have a THF-insoluble matter in a content of from 10 to 80% by weight, and more preferably from 10 to 60% by weight, based on the weight of the polymerization toner. If its THF-insoluble matter is in a content less than 10% by weight, its running performance may be damaged. If on the other hand it is in a content more than 80% by weight, the fixing performance of the toner may be damaged to make images on OHP sheet have a poor transparency, undesirably.

The THF-insoluble matter is measured in the manner as described below. The "THF-insoluble matter" shows the weight proportion of insoluble substances to the solvent THF in the toner. The THF-insoluble matter is defined by the value measured in the following way.

A resin or toner sample is weighed in an amount of 0.5 to 1.0 g ($W_1$ g), which is then put in a cylindrical filter paper (e.g., No. 86R, available from Toyo Roshi K.K.) and set on a Soxhlet extractor. Extraction is carried out for 6 hours using from 100 to 200 ml of THF as a solvent, and the soluble component thus extracted is concentrated, followed by vacuum drying at 100° C. for several hours. Then the content of the THF-soluble resin component is weighed and represented as $W_2$ g. The weight of components other than the resin component, such as a pigment, is measured and represented as $W_3$ g.

The THF-insoluble matter is determined from the following equation.

$$\text{THF-insoluble matter (\% by weight)}=[\{(W_1-(W_3+W_2)\}/(W_1-W_3)]\times 100$$

The polymerizable-monomer composition may also preferably be incorporated with a low-softening substance in an amount of from 1 to 50 parts by weight, and more preferably from 5 to 30 parts by weight, based on 100 parts by weight of the polymerizable monomer. The low-softening substance may also preferably be a release agent ester wax. If the low-softening substance is less than 1 part by weight, the toner tends to have a poor fixing performance on the high-temperature side and, when images are fixed on an OHP sheet, the sheet may wind around the fixing roller. If the low-softening substance is more than 50 parts by weight, the toner may have a low fluidity to tend to make developing performance and transfer performance poor.

The low-softening substance used in the present invention may preferably include ester waxes represented by the following Formulas (I) to (VI).

Formula (I)

$$[R_1\text{—COO—}(CH_2)_n\text{—}]_a\text{—C—}[\text{—}(CH_2)_m\text{—OCO—}R_2]_b$$

wherein a and b are each an integer of 0 to 4, provided that a+b is 4; $R_1$ and $R_2$ are each an organic group having 1 to 40 carbon atoms, provided that the difference in carbon atom number between $R_1$ and $R_2$ is 3 or more; and m and n are each an integer of 0 to 25, provided that m and n are not 0 at the same time.

Formula (II)

$$[R_1\text{—COO—}(CH_2)_n\text{—}]_a\text{—}\overset{(R_3)_k}{\overset{|}{C}}\text{—}[(CH_2)_m\text{—OCO—}R_2]_b$$

wherein a and b are each an integer of 0 to 3, provided that a+b is 1 to 3; $R_1$ and $R_2$ are each an organic group having 1 to 40 carbon atoms, provided that the difference in carbon atom number between $R_1$ and $R_2$ is 3 or more; $R_3$ is a hydrogen atom or an organic group having 1 or more carbon atoms; provided that, when a+b is 2, one of $R_3$'s is an organic group having 1 or more carbon atoms; k is an integer of 1 to 3; and m and n are each an integer of 0 to 25, provided that m and n are not 0 at the same time.

Formula (III)

$$R_1\text{—OCO—}R_2\text{—COO—}R_3$$

wherein $R_1$ and $R_3$ are each an organic group having 6 to 32 carbon atoms, and $R_1$ and $R_3$ may be the same or different; and $R_2$ represents an organic group having 1 to 20 carbon atoms.

Formula (IV)

$$R_1\text{—COO—}R_2\text{—OCO—}R_3$$

wherein $R_1$ and $R_3$ are each an organic group having 6 to 32 carbon atoms, and $R_1$ and $R_3$ may be the same or different; and $R_2$ is $\text{—}CH_2CH_2OC_6H_4OCH_2CH_2\text{—}$, $$\text{—}(CH(CH_3)CH_2O)_m\text{—}C_6H_4C(CH_3)_2C_6H_4\text{—}(OCH_2\overset{CH_3}{\overset{|}{C}}H)_m\text{—}$$

or $\text{—}(CH_2)_n\text{—}$; m represents an integer of 1 to 10; and n represents an integer of 1 to 20.

Formula (V)

$$[R\text{—COO—}(CH_2)_n\text{—}]_a\text{—C—}[\text{—}(CH_2)_m\text{—OH}]_b$$

wherein a is an integer of 0 to 4 and b is an integer of 1 to 4, provided that a+b is 4; $R_1$ is an organic group having 1 to 40 carbon atoms; and m and n are each an integer of 0 to 25, provided that m and n are not 0 at the same time.

Formula (VI)

$$R_1\text{—COO—}R_2$$

wherein $R_1$ and $R_2$ may be the same or different, and each represent a hydrocarbon group having 15 to 45 carbon atoms.

As ester waxes used as release agents comprised of ester compounds, they are exemplified as shown below.

Release agent No. 1

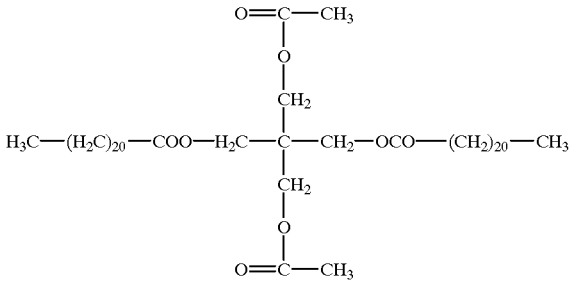

Release agent No. 2

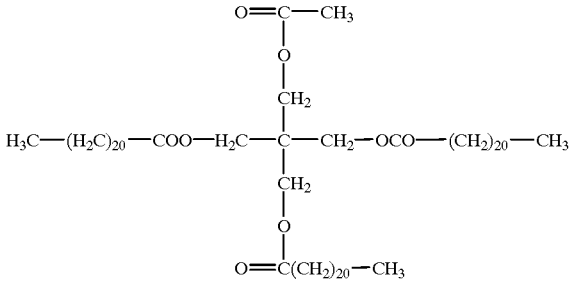

Release agent No. 3

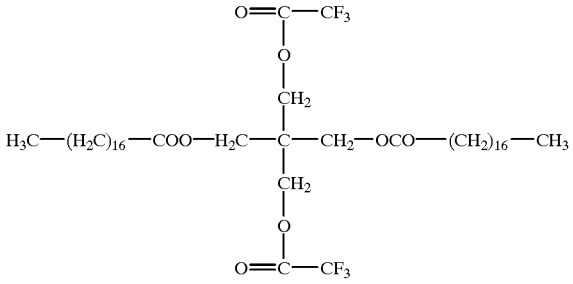

-continued

Release agent No. 4

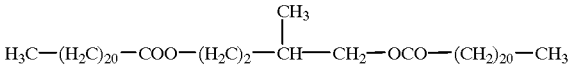

Release agent No. 5

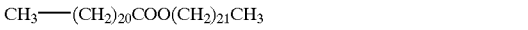

Release agent No. 6

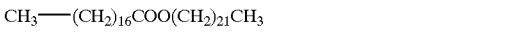

Release agent No. 7

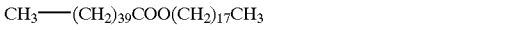

Release agent No. 8

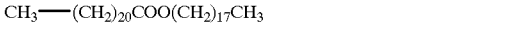

Release agent No. 9

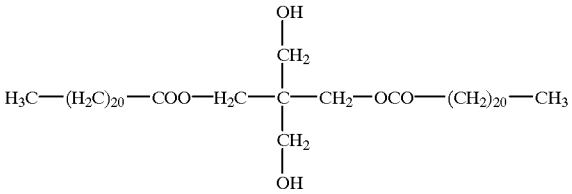

Release agent No. 10

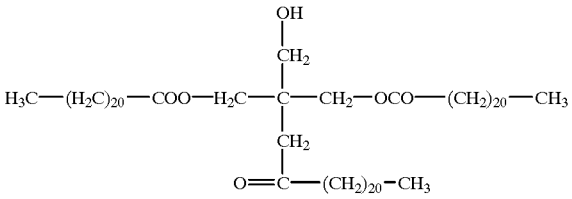

Release agent No. 11

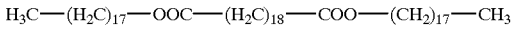

Release agent No. 12

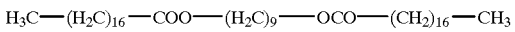

In the case when the low-softening substance is any of the ester waxes having ester compounds of the above structural formulas, it contributes to the achievement of good transparency and also, when incorporated into toner particles, good fixing performance. This wax and the above polar resin may be dissolved in the polymerizable monomer and thereafter the polymerization reaction of the polymerizable monomer may be made to proceed in the aqueous medium, whereby a superior toner is obtainable whose toner particles thus obtained can have a large charge quantity and can reach an appropriate charge value at a high rate and which may cause less variation of the quantity of triboelectricity.

The low-softening substance (wax) used in the present invention may preferably be a compound showing a main maximum peak value (melting point) of from 50 to 120° C. as measured according to ASTM D3418-8. If the maximum peak value is lower than 50° C., the low-softening substance (wax) may have a weak self-cohesive force, undesirably resulting in weak high-temperature anti-offset properties. If on the other hand the maximum peak value is higher than 120° C., a high fixing temperature may result, undesirably. In the case when the toner particles are directly obtained by polymerization, since the granulation and polymerization are carried out in the aqueous medium, the low-softening substance may undesirably precipitate chiefly during the granulation to inhibit the suspension system if the maximum peak value is at a high temperature.

The temperature of the maximum peak value in the present invention is measured using, e.g., a differential scanning calorimeter DSC-7, manufactured by Perkin Elmer Co. The temperature at the detecting portion of the device is corrected on the basis of melting points of indium and zinc, and the calorie is corrected on the basis of heat of fusion of indium. The sample is put in a pan made of aluminum and an empty pan is set as a control, to make measurement at a rate of heating of 10° C./min.

The low-softening substance ester wax may be used in combination with any of paraffin waxes, polyolefin waxes, Fischer-Tropsch waxes, amide waxes, higher fatty acids, and derivatives of these or grafted or blocked compounds of these.

As the colorant used in the present invention, carbon black, magnetic materials, and colorants toned in black by the use of yellow, magenta and cyan colorants shown below are used as black colorants.

As a yellow colorant, compounds typified by condensation azo compounds, isoindolinone compounds, anthraquinone compounds, azo metal complexes, methane compounds and allylamide compounds are used. Stated specifically, C.I. Pigment Yellow 12, 13, 14, 15, 17, 62, 74, 83, 93, 94, 95, 109, 110, 111, 128, 129, 147, 168 and 180 are preferably used.

As a magenta colorant, condensation azo compounds, diketopyrroropyrole compounds, anthraquinone compounds, quinacridone compounds, basic dye lake compounds, naphthol compounds, benzimidazolone compounds, thioindigo compounds and perylene compounds are used. Stated specifically, C.I. Pigment Red 2, 3, 5, 6, 7, 23, 48:2, 48:3, 48:4, 57:1, 81:1, 122, 146, 166, 169, 177, 184, 185, 202, 206, 220, 221 and 254 are particularly preferable.

As a cyan colorant used in the present invention, copper phthalocyanine compounds and derivatives thereof, anthraquinone compounds and basic dye lake compounds may be used. Stated specifically, C.I. Pigment Blue 1, 7, 15, 15:1, 15:2, 15:3, 15:4, 60, 62 and 66 may particularly preferably be used.

Any of these colorants may be used alone, in the form of a mixture, or in the state of a solid solution. The colorants used in the present invention are selected taking account of hue angle, chroma, brightness, weatherability, transparency on OHP films and dispersibility in toner particles. The colorant may preferably be used in an an amount of from 1 to 20 parts by weight based on 100 parts by weight of the binder resin.

The polymerization toner according to the present invention may also be incorporated with a magnetic material so that it can be used as a magnetic toner. In this case, the magnetic material may also serve as the colorant. The magnetic material incorporated in the magnetic toner may include iron oxides such as magnetite, hematite and ferrite; metals such as iron, cobalt and nickel, or alloys of any of these metals with a metal such as aluminum, cobalt, copper, lead, magnesium, tin, zinc, antimony, beryllium, bismuth, cadmium, calcium, manganese, selenium, titanium, tungsten or vanadium, and mixtures of any of these.

The magnetic material used in the present invention may preferably be a surface-modified magnetic material, and may more preferably be those having been subjected to hydrophobic treatment with a surface modifier which is a substance having no polymerization inhibitory action. Such a surface modifier may include, e.g., silane coupling agents and titanium coupling agents.

These magnetic materials may preferably be those having an average particle diameter of 2 $\mu$m or smaller, and preferably from about 0.1 to 0.5 μm. As quantity in which it is incorporated in the toner particles, it may preferably be used in an amount of from 20 to 200 parts by weight, and particularly preferably from 40 to 150 parts by weight, based on 100 parts by weight of the binder resin.

The magnetic material may preferably be one having a coercive force (Hc) of from 1.59 to 23.9 kA/m, a saturation magnetization (σs) of from 50 to 200 $Am^2/kg$ and a residual magnetization (σr) of from 2 to 20 $Am^2/kg$, as magnetic characteristics under application of $7.96\times10^2$ kA/m (10 K oersteds).

The polymerization toner according to the present invention may contain a charge control agent.

As charge control agents capable of controlling the toner to be negatively chargeable, they include the following substances. For example, organic metal compounds or chelate compounds are effective, which may include monoazo metal compounds, acetylacetone metal compounds, aromatic monocarboxylic acid metal compounds, aromatic hydroxycarboxylic acid metal compounds, aromatic dicarboxylic acid metal compounds and aromatic polycarboxylic acid metal compounds, and metal salts, anhydrides or esters thereof may also be used. Besides, they may include phenol derivatives such as bisphenol. They may further include urea derivatives, metal-containing salicylic acid compounds, metal-containing naphthoic acid compounds, boron compounds, quaternary ammonium salts, and carixarene. When used in combination with the polar resin, metal-containing salicylic acid compounds are preferred.

Charge control agents capable of controlling the toner to be positively chargeable include the following substances. They may include Nigrosine and Nigrosine-modified products, modified with a fatty acid metal salt; guanidine compounds, imidazole compounds, quaternary ammonium salts such as tributylbenzylammonium 1-hydroxy-4-naphthosulfonate and tetrabutylammonium teterafluoroborate, and analogues of these, including onium salts such as phosphonium salts, and lake pigments of these; triphenylmethane dyes and lake pigments of these (lake-forming agents may include tungstophosphoric acid, molybdophosphoric acid, tungstomolybdophosphoric acid, tannic acid, lauric acid, gallic acid, ferricyanides and ferrocyanides); metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate. Any of these may be used alone or in combination of two or more kinds.

The charge control agent may preferably be used in an amount of from 0.01 to 20 parts by weight, and more preferably from 0.5 to 10 parts by weight, based on 100 parts by weight of the binder resin.

Additives used in the toner in order to provide various properties may preferably have a particle diameter of not more than ⅕of the volume average diameter of toner particles in view of their durability. This particle diameter of the additives is meant to be an average particle diameter measured using an electron microscope by observing surfaces of toner particles. As these additives used for the purpose of providing various properties, the following may be used, for example.

As fluidity-providing agents, they may include metal oxides such as silicon oxide, aluminum oxide and titanium oxide, carbon black, and carbon fluoride. These may more preferably be those having been subjected to hydrophobic treatment.

As abrasives, they may include metal oxides such as cerium oxide, aluminum oxide, magnesium oxide and chromium oxide, nitrides such as silicon nitride, carbides such as silicon carbide, and metal salts such as strontium titanate, calcium sulfate, barium sulfate and calcium carbonate.

As lubricants, they may include fluorine resin powders such as vinylidene fluoride and polytetrafluoroethylene, and fatty acid metal salts such as zinc stearate and calcium stearate.

As charge controlling particles, they may include metal oxides such as tin oxide, titanium oxide, zinc oxide, silicon oxide and aluminum oxide, and carbon black.

Any of these additives may be used in an amount of from 0.1 part to 10 parts by weight, and preferably from 0.1 part to 5 parts by weight, based on 100 parts by weight of the toner particles. Any of these additives may be used alone or in combination of plural ones.

When the polymerization toner is obtained by the process of the present invention, seed polymerization may also preferably be used in which polymerization particles once obtained are further made to adsorb a monomer and thereafter the polymerization initiator is used to carry out polymerization. Here, a compound having polarity may also be used by dissolving or dispersing it in the monomer to be adsorbed.

As the process for producing toner particles, the low-softening substance such as wax, the colorant, the cross-linking agent and other additives are added to the polymerizable monomer and are uniformly dissolved or dispersed by means of, e.g., a homogenizer or a ultrasonic dispersion machine to prepare a monomer composition previously. Then, (1) the polymerizable-monomer composition is dropwise added to the aqueous medium containing a dispersion stabilizer, with stirring by means of, e.g., a high-speed rotary-shearing stirrer TK Homomixer (manufactured by Tokushu Kika Kogyo K.K.), CLEAR MIX (manufactured by M. Technique K.K.), Polytron Homogenizer (KINEMATICA Corp.) or Supraton (manufactured by Tsukishima Kikai K.K.) to effect dispersion, and then the polymerization initiator is added therein according to the condition of the present invention, or (2) the polymerizable-monomer composition is dropwise added to the aqueous medium containing a dispersion stabilizer, with stirring by means of, e.g., a high-speed rotary-shearing stirrer TK Homomixer (manufactured by Tokushu Kika Kogyo K.K.), CLEAR MIX (manufactured by M. Technique K.K.), Polytron Homogenizer (KINEMATICA Corp.) or Supraton (manufactured by Tsukishima Kikai K.K.) to effect dispersion, and, after the step of granulation has been completed, the polymerization initiator is added according to the condition of the present invention with stirring by means of, e.g., any of a propeller blade, a paddle blade, an anchor blade and a ribbon blade, and besides Max Blend Blade (manufactured by Sumitomo Heavy Industries, Ltd.) and Fullzone Blade (manufactured by Shinko Pantec Co.), or (3) the polymerization initiator is added to the aqueous medium containing a dispersion stabilizer, according to the condition of the present invention, being added optionally with stirring by means of, e.g., a high-speed rotary-shearing stirrer TK Homomixer (manufactured by Tokushu Kika Kogyo K.K.), CLEAR MIX (manufactured by M. Technique K.K.), Polytron Homogenizer (KINEMATICA Corp.) or Supraton (manufactured by Tsukishima Kikai K.K.) to effect dispersion, and thereafter, the above polymerizable-monomer composition is introduced into the aqueous medium according to the condition of the present invention to effect granulation. After the granulation, agitation may be carried out to such an extent that the state of particles is maintained and the particles can be prevented from settling, by the action of the dispersion stabilizer. The polymerization may be carried out at a polymerization temperature set at 40° C. or above, usually from 50 to 90° C. (preferably from 55 to 85° C.). At the latter half of the polymerization, the temperature may be raised, and also the aqueous medium may be removed in part from the reaction system at the latter half of the polymerization reaction or after the reaction has been completed, in order to remove unreacted polymerizable monomers, by-products and so forth which may cause a smell at the time of toner fixing. After the polymerization reaction has been completed, the toner particles formed are collected by washing and filtration, followed by drying.

In the suspension polymerization, water may usually be used as the dispersion medium preferably in an amount of from 300 to 3,000 parts by weight based on 100 parts by weight of the monomer composition.

The dispersion stabilizer (dispersant) to be used may include, e.g., as inorganic oxides, tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica and alumina. As organic compounds, it may include, e.g., polyvinyl alcohol, gelatin, methyl cellulose, methyl hydroxypropyl cellulose, ethyl cellulose, carboxymethyl cellulose sodium salt, and starch. Any of the stabilizers may preferably be used in an amount of from 0.2 to 2.0 parts by weight based on 100 parts by weight of the polymerizable monomer.

As these dispersants, those commercially available may be used as they are. In order to obtain fine particles having fine uniform particle size, however, the inorganic compound may be formed in the dispersion medium and under high-speed agitation. For example, in the case of tricalcium phosphate, an aqueous sodium phosphate solution and an aqueous calcium chloride solution may be mixed under high-speed agitation, whereby a dispersant preferable for the suspension polymerization can be obtained.

In order to make these dispersants fine, 0.001 to 0.1% by weight of a surface-active agent may be used in combination. Stated specifically, commercially available nonionic, anionic or cationic surface-active agents may be used. For example, preferably usable are sodium dodecylbenzenesulfonate, sodium tetradecyl sulfate, sodium pentadecyl sulfate, sodium octyl sulfate, sodium oleate, sodium laurate, potassium stearate and calcium oleate.

As colorants used in the toner obtained by the polymerization, attention must be paid to polymerization inhibitory action or aqueous-phase transfer properties inherent in the colorants. The colorant should more preferably be subjected to surface modification, e.g., hydrophobic treatment which makes the colorants free from polymerization inhibition. In particular, most dyes and carbon black have the polymerization inhibitory action and hence care must be taken when used. A preferable method for the surface treatment of the dyes may include a method in which the polymerizable monomer is previously polymerized in the presence of any of these dyes. The resulting colored polymer may be added to the monomer composition. With regard to the carbon black, besides the same treatment on the dyes, it may be treated with a material capable of reacting with surface functional groups of the carbon black, as exemplified by polyorganosiloxane.

In the present invention, the toner may preferably have an average circularity of from 0.95 to 1.00. This is because the toner can be made to have particle surfaces with uniform strength, and can have a superior resistance to stress and also be improved in developing performance and transfer performance.

The circularity of the toner in the present invention is used as a simple method for expressing the shape of toner quantitatively. In the present invention, it is measured with a flow type particle image analyzer FPIA-1000, manufactured by Toa Iyou Denshi K.K., and the circularity is calculated according to the following expression.

$$\text{Circle-corresponding diameter} = (\text{particle projected area}/\pi)^{1/2} \times 2$$

$$\text{Circularity} = \frac{\text{Circumferential length of a circle with the same area as particle projected area}}{\text{Circumferential length of particle projected image}}$$

Here, the "particle projected area" is meant to be the area of a binary-coded toner particle image, and the "circumferential length of particle projected image" is defined to be the length of a contour line formed by connecting edge points of the toner particle image.

The circularity referred to in the present invention is an index showing the degree of surface unevenness of toner particles. It is indicated as 1.000 when the toner particles are perfectly spherical. The more complicate the surface shape is, the smaller the value of circularity is.

Incidentally, in the present invention, particles having a circle-corresponding diameter of from 1 to 400 $\mu$m are used for the measurement.

In the toner according to the present invention, toner particles having a circle-corresponding diameter smaller than 2.0 $\mu$m as measured with the flow type particle image analyzer may preferably be not more than 40% by number. If they are more than 40% by number, the toner tends to cause faulty charging during many-sheet running because of contamination of charging members such as a carrier and a developing sleeve.

The toner according to the present invention may also have a weight-average molecular weight of from 4 to 10 $\mu$m, as measured by a measuring method described later.

The polymerization toner produced by the production process of the present invention may be used as the toner of a non-magnetic one-component developer, or may be used as a toner for a two-component developer having carrier particles. Where a non-magnetic toner is used, there is a method in which the toner is transported by forcedly triboelectrically charging it by the aid of a developing sleeve to cause it to adhere onto the sleeve, using a blade or a roller.

Where the toner is used as a two-component developer, a carrier is used together with the toner according to the present invention so as to be used as the developer. As a magnetic carrier, it may be constituted solely of element comprising iron, copper, zinc, nickel, cobalt, manganese or chromium element or in the state of a composite ferrite carrier. As the shape of magnetic-carrier particles, the particles may be spherical, flat or shapeless. It is also preferable to control the microstructure of carrier particle surfaces (e.g., surface unevenness). What is commonly used is a method in which an inorganic oxide is fired and granulated to beforehand produce carrier core particles, which are thereafter coated with resin. From the meaning of lessening the load of carrier to toner, it is also possible to use a method in which an inorganic oxide and the resin are kneaded, followed by pulverization and classification to obtain a low-density dispersed carrier, or a method in which a kneaded product of an inorganic oxide and monomers is subjected to suspension polymerization in an aqueous medium to obtain a true-spherical magnetic carrier directly.

A coated carrier comprising carrier particles surface-coated with resin is particularly preferred. As methods therefor, applicable are a method in which a resin dissolved or suspended in a solvent is coated to make it adhere to carrier particles, or a method in which the resin is merely mixed in the form of a powder to make it adhere to carrier particles.

The material made to adhere to the carrier particle surfaces may differ depending on toner materials. For example, it may include polytetrafluoroethylene, monochlorotrifluoroethylene polymer, polyvinylidene fluoride, silicone resins, polyester resins, styrene resins, acrylic resins, polyamide, polyvinyl butyral, and aminoacrylate resins. Any of these may be used alone or in combination.

The carrier may be those having the following magnetic characteristics: Its magnetization intensity ($\sigma_{79.6}$) under application of 79.6 kA/m (1,000 oersteds) after it has been magnetically saturated is required to be from 3.77 to 37.7 $\mu$Wb/cm$^3$. In order to achieve a higher image quality, it may preferably be from 12.6 to 31.4 $\mu$Wb/cm$^3$. If it is greater than 37.7 $\mu$Wb/cm$^3$, it may be difficult to obtain toner images having a high image quality. It it is smaller than 3.77 $\mu$Wb/cm$^3$, the carrier may have less magnetic binding force to tend to cause carrier adhesion.

In the case when the toner according to the present invention is blended with the magnetic carrier to prepare the two-component developer, they may be blended in a ratio such that the toner in the developer is in a concentration of from 2 to 15% by weight, and preferably from 4 to 13 by weight, whereby good results can usually be obtained.

Image-forming methods to which the toner produced by the process of the present invention is applicable are described below with reference to the accompanying drawings.

Figure 2:
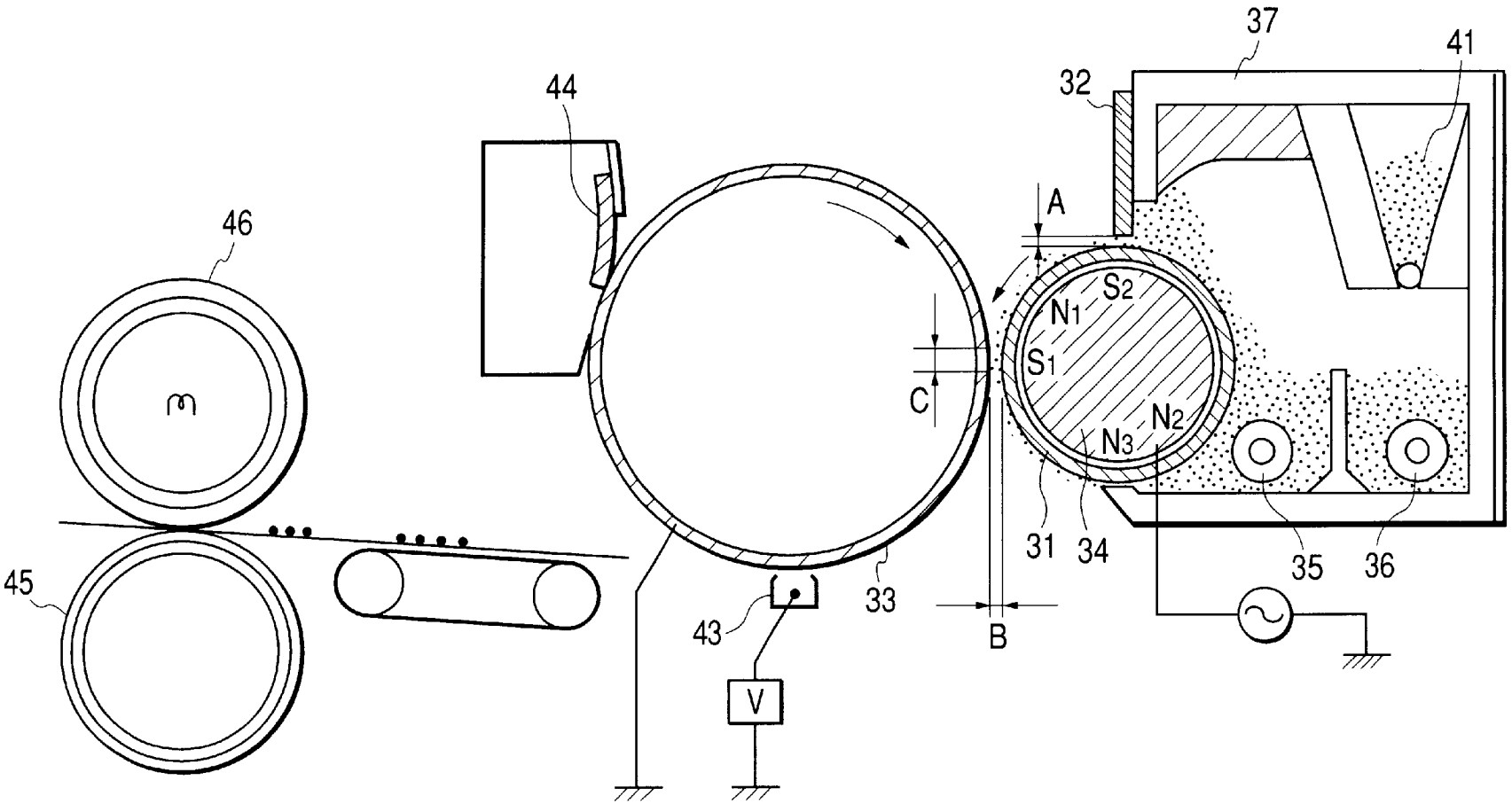
FIG. 2 is a schematic view of an apparatus having a developing means to which the toner according to the present invention is used.

The toner according to the present invention may be blended with the magnetic carrier so that development can be made using, e.g., a developing means (developing assembly) 37 as shown in FIG. 2. Stated specifically, the development may preferably be carried out applying an alternating electric field and in such a state that a magnetic brush formed of the toner and the magnetic carrier comes into touch with an electrostatic-image-bearing member (e.g., photosensitive drum) 33. A distance B between a developer carrying member (developing sleeve) 31 and the photosensitive drum 33 (distance between S-D) may preferably be from 100 to 1,000 $\mu$m. This is desirable for preventing carrier adhesion and improving dot reproducibility. If it is smaller (i.e., the gap is narrower) than 100 $\mu$m, the developer tends to be insufficiently fed, resulting in a low image density. If it is larger than 1,000 $\mu$m, the magnetic line of force from a magnetic pole S1 held may broaden to make the magnetic brush have a low density, resulting in a poor dot reproducibility, or to weaken the force of binding the carrier, tending to cause carrier adhesion. A toner 41 is successively fed to the developing assembly 37 and is blended with the carrier by agitation and transport means 35 and 36. The toner and carrier thus blended are transported to the developing sleeve 31 holding a stationary magnet 34 internally.

The alternating electric field may preferably be applied at a peak-to-peak voltage (Vpp) of from 500 to 5,000 V and a frequency (f) of from 500 to 10,000 Hz, and preferably from 500 to 3,000 Hz, which may each be applied to the process under appropriate selection. In this case, the waveform used may be selected from triangular waveform, rectangular waveform, sinusoidal waveform, or waveform with a varied duty ratio.

If the peak-to-peak voltage applied is lower than 500 V, a sufficient image density may be attained with difficulty, and fog toner at non-image areas may not well be collected in some cases. If it is higher than 5,000 V, the electrostatic latent image may be disordered through the magnetic brush to cause a lowering of image quality.

Use of a two-component developer having a toner well charged enables application of a low fog take-off voltage (Vback), and enables the photosensitive member to be low charged in its primary charging, thus the photosensitive member can be made to have a longer lifetime. The Vback, which may depend on the development system, may preferably be 150 V or below, and more preferably 100 V or below.

As contrast potential, a potential of from 200 V to 500 V may preferably be used so that a sufficient image density can be achieved.

If the frequency (f) is lower than 500 Hz, electric charges may be injected into the carrier, relating also to the process speed, so that carrier adhesion may occur or latent images may be disordered to cause a lowering of image quality. If it is higher than 10,000 Hz, the toner can not follow up the electric field to tend to cause a lowering of image quality.

In order to carry out development promising a sufficient image density, achieving a superior dot reproducibility and free of carrier adhesion, the magnetic brush on the developing sleeve 31 may preferably be made to come into touch with the photosensitive drum 33 at a width (developing nip C) of from 3 to 8 mm. If the developing nip C is narrower than 3 mm, it may be difficult to well satisfy sufficient image density and dot reproducibility. If it is broader than 8 mm, the developer may pack into the nip to cause the machine to stop from operating, or it may be difficult to well prevent the carrier adhesion. As methods for adjusting the developing nip, the nip width may appropriately be adjusted by adjusting the distance A between a developer-regulating blade 32 and the developing sleeve 31, or by adjusting the distance B between the developing sleeve 31 and the photosensitive drum 33.

In the formation of full-color images which attaches importance especially to halftones, three or more developing assemblies for magenta, cyan and yellow may be used, and the developer and developing process making use of the toner according to the present invention may be used, especially in combination with a development system in which digital latent images are formed. Thus, the latent images are not affected by the magnetic brush and are not disordered, and hence can be developed faithfully to the dot images. In the transfer step, too, the use of the toner according to the present invention enables achievement of a high transfer efficiency, and therefore enables achievement of a high image quality in both halftone areas and solid areas.

In addition, concurrently with achievement of a high image quality at the initial stage, the use of the toner according to the present invention can well bring about the effect of the present invention without any lowering of image quality even in many-sheet copying.

The toner image held on the electrostatic-image-bearing member 33 is transferred onto a transfer medium by a transfer means 43 such as a corona charging assembly. The toner image thus held on the transfer medium is fixed by a heat-and-pressure fixing means having a heating roller 46 and a pressure roller 45. Transfer residual toner remaining on the electrostatic-image-bearing member 33 is removed from the surface of the electrostatic-image-bearing member 33 by a cleaning means 44 such as a cleaning blade. The toner according to the present invention has so high a transfer efficiency in the transfer step as to leave less transfer residual toner, and also has superior cleaning performance.

Hence, it may hardly cause the filming on the electrostatic-image-bearing member. Moreover, even when tested on many-sheet running, the external additives in the toner according to the present invention may less be buried in the toner particle surfaces than those in any conventional toners, and hence good image quality can be maintained over a long period of time.

In order to obtain good full-color images, development for black may preferably finally be made, using an image-forming apparatus having developing assemblies for magenta, cyan, yellow and black, whereby images can assume a tightness.

An example of an image-forming apparatus which can well carry out a multi-color or full-color image formation process is described below with reference to FIG. 3.

Figure 3:
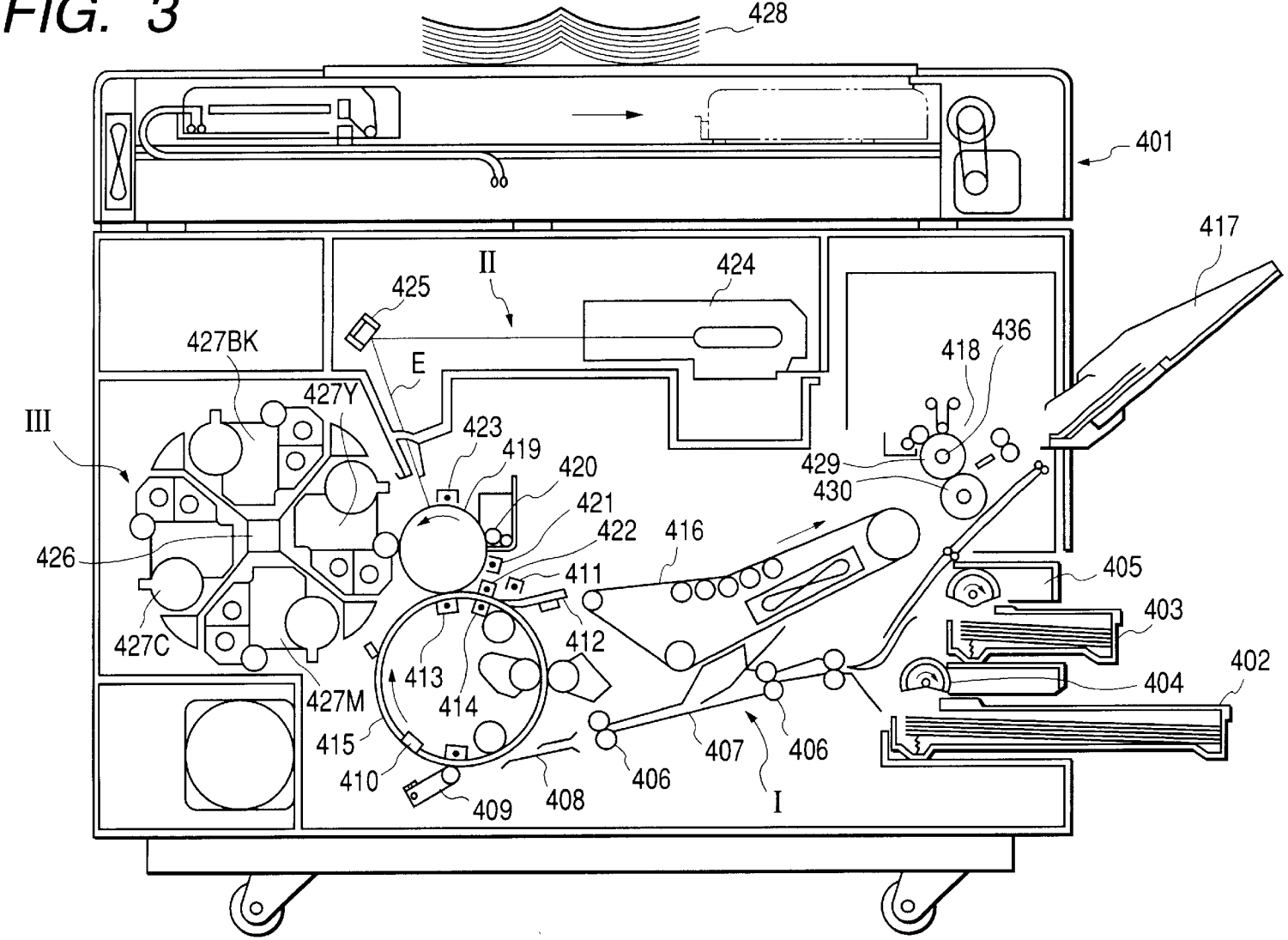
FIG. 3 is a schematic view used to describe a process for forming full-color or multi-color images.

A full-color electrophotographic apparatus illustrated in FIG. 3 is roughly grouped into a transfer medium transport system I so provided as to extend from the right side (as viewed in FIG. 3) of the main body of the apparatus to substantially the middle of the main body of the apparatus, a latent image forming zone II provided in substantially the middle of the main body of the apparatus and in proximity to a transfer drum 415 constituting the transfer medium transport system I, and a developing means (i.e., a rotary developing unit) III provided in proximity to the latent image forming zone II.

The above transfer medium transport system I is constructed in the following way. It has openings formed on the right side (the right side in FIG. 3) of the main body of the apparatus, and is provided with transfer medium feeding trays 402 and 403 detachable through the openings in the manner that they partly extend toward the outside of the apparatus. Paper feed rollers 404 and 405 are provided almost directly above the trays 402 and 403, respectively, and another paper feed roller 406 and paper guides 407 and 408 are provided in the manner that the paper feed rollers 404 and 405 can be associated with the transfer drum 415 provided on the left side and rotatable in the direction of an arrow A. A contacting roller 409, a gripper 410, a transfer medium separating corona assembly 411 and a separating claw 412 are sequentially provided in the vicinity of the periphery of the transfer drum 415 from the upstream side to the downstream side in the direction of its rotation.

A transfer corona assembly 413 and a transfer medium separating corona assembly 414 are provided inside the periphery of the transfer drum 415. A transfer sheet (not shown) formed of a polymer such as polyvinylidene fluoride is stuck to the part where transfer mediums on the transfer drum 415 wind around, and the transfer mediums are electrostatically brought into close contact with the surface of the transfer sheet. A paper delivery belt means 416 is provided in proximity to the separating claw 412 at the right upper part of the transfer drum 415, and a fixing assembly 418 is provided at the terminal (the right side) of the transfer medium transport direction of the paper delivery belt means 416. A paper output tray 417 extending to the outside of the main body 401 of the apparatus and detachable from the main body 401 thereof is provided more downstream in the transport direction than the fixing assembly 418.

The latent image forming zone II is constructed as described below. As a latent-image-bearing member, a photosensitive drum (e.g. an OPC photosensitive drum) 419 rotatable in the direction of an arrow in FIG. 3 is provided in the manner that its periphery comes into contact with the periphery of the transfer drum 415. Above the photosensitive drum 419 and in the vicinity of the periphery thereof, a residual charge eliminating corona assembly 421, a cleaning means 420 and a primary corona assembly 423 are sequentially provided from the upstream side to the down stream side in the direction of rotation of the photosensitive drum 419. An imagewise exposure means 424 such as a laser beam scanner to form an electrostatic latent image on the periphery of the photosensitive drum 419, and an imagewise exposing light reflecting means 425 such as a mirror are also provided.

The rotary developing unit III is constructed in the following way. It comprises a rotatable housing (hereinafter "rotating support") 426 provided at the position facing the periphery of the photosensitive drum 419. In the rotating support 426, four kinds of developing assemblies are independently mounted and are so constructed that electrostatic latent images formed on the periphery of the photosensitive drum 419 can be converted into visible images (i.e., developed). The four kinds of developing assemblies comprise a yellow developing assembly 427Y, a magenta developing assembly 427M, a cyan developing assembly 427C and a black developing assembly 427BK, respectively.

The sequence of the whole image forming apparatus constructed as described above will be described by giving an example of full-color mode image formation. With the rotation of the above photosensitive drum 419 in the direction of the arrow in FIG. 3, the photosensitive drum 419 is electrostatically charged by means of the primary corona assembly 423. In the apparatus shown in FIG. 3, each component part is operated at a peripheral speed (hereinafter "process speed") of 100 mm/sec or higher, e.g., 130 to 250 mm/sec. Upon the electrostatic charging on the photosensitive drum 419 by means of the primary corona assembly 423, imagewise exposure is effected using laser light E modulated by yellow image signals of an original 428, so that an electrostatic latent image is formed on the photosensitive drum 419, and then the electrostatic latent image is developed by means of the yellow developing assembly 427Y previously set stationary at a developing position by the rotation of the rotating support 426. Thus, a yellow toner image is formed.

The transfer medium transported through the paper feed guide 407, paper feed roller 406 and paper feed guide 408 is held fast by the gripper 410 at a given timing, and is electrostatically wound around the transfer drum 415 by means of the contacting roller 409 and an electrode set opposingly to the contacting roller 409. The transfer drum 415 is rotated in the direction of the arrow in FIG. 3 in synchronization with the photosensitive drum 419. The yellow toner image formed by the development with the yellow developing assembly 427Y is transferred to the transfer medium by means of the transfer corona assembly 413 at the portion where the periphery of the photosensitive drum 419 and the periphery of the transfer drum 415 come into contact with each other. The transfer drum 415 is continued rotating without stop, and stands ready for a next color (magenta as viewed in FIG. 3).

The photosensitive drum 419 is destaticized by means of the residual charge eliminating corona assembly 421, and is cleaned through the cleaning means 420. Thereafter, it is again electrostatically charged by means of the primary corona assembly 423, and is subjected to imagewise exposure according to the next magenta image signals, where an electrostatic latent image is formed. The above rotary developing unit is rotated while the electrostatic latent image is formed on the photosensitive drum 419 according to the magenta image signals as a result of the imagewise exposure, until the magenta developing assembly 427M is set stationary at the above given developing position, where the development is carried out using a given magenta toner. Subsequently, the process as described above is also carried out on a cyan color and a black color each. After transfer steps corresponding to the four colors have been completed, four-color visible images formed on the transfer medium are destaticized by the corona assemblies 422 and 414, and the transfer medium held by the gripper 410 is released therefrom. At the same time, the transfer medium is separated from the transfer drum 415 by means of the separating claw 412, and then delivered to the fixing assembly 418 having a fixing roller 429 with a heat generator 436 in the inside and a pressure roller 430 over the delivery belt 416, where the images are fixed by the action of heat and pressure. Thus, the sequence of full-color print is completed and the desired full-color print image is formed on one side of the transfer medium.

Another image-forming method is specifically described below with reference to FIG. 4.

Figure 4:
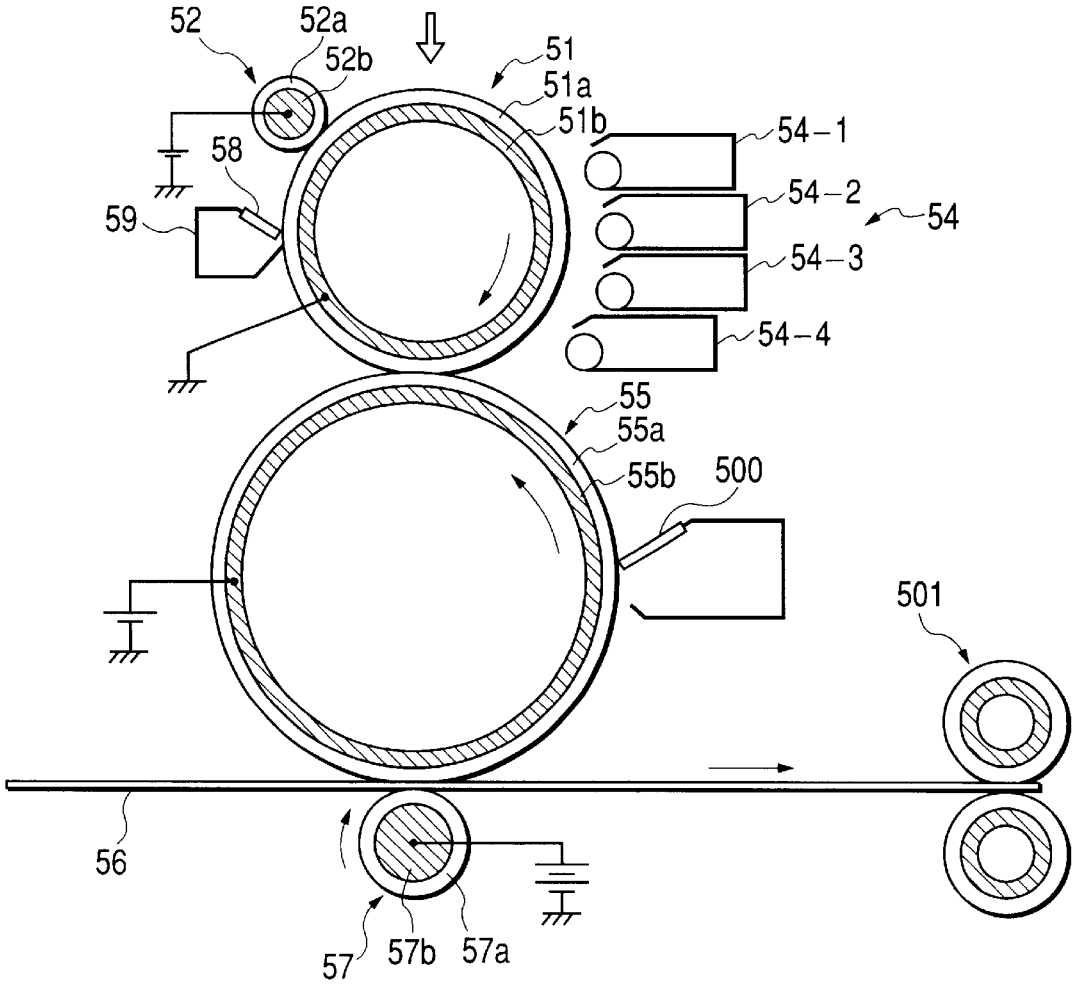
FIG. 4 is a schematic view used to describe an image-forming process making use of an intermediate transfer member.

In the apparatus system shown in FIG. 4, a developer having a cyan toner, a developer having a magenta toner, a developer having a yellow toner and a developer having a black toner are put into developing assemblies 54-1, 54-2, 54-3 and 54-4, respectively. Electrostatic latent images formed on a photosensitive member 51 are developed to form toner images of respective colors on the photosensitive member 51. The photosensitive member 51 is a photosensitive drum or photosensitive belt having a layer (photosensitive layer) 51*a* of a photoconductive insulating material layer formed of a-Se, CdS, $ZnO_2$, OPC or a-Si. As the photosensitive member 51, a photosensitive member having an amorphous silicon photosensitive layer or an organic photosensitive layer may preferably be used.

The organic photosensitive layer may be of a single-layer type in which the photosensitive layer contains a charge generating material and a charge transporting material in the same layer, or may be a function-separated photosensitive layer comprised of a charge transport layer and a charge generation layer. A multi-layer type photosensitive layer comprising a conductive substrate and formed superposingly thereon the charge generation layer and the charge transport layer in this order is one of preferred examples.

As binder resins for the organic photosensitive layer, polycarbonate resins, polyester resins or acrylic resins are preferred because they have an especially good transfer performance and cleaning performance, and may hardly cause faulty cleaning, melt-adhesion of toner to the photosensitive member and filming of external additives.

The step of charging has a system making use of a corona charging assembly and being in non-contact with the photosensitive member 51, or a contact type system making use of a roller or the like. Either system may be used. The contact type system as shown in FIG. 4 may preferably be used so as to enable efficient and uniform charging, simplify the system and make ozone less occur.

A charging roller 52 is constituted basically of a mandrel 52*b* and a conductive elastic layer 52*a* that forms the periphery of the former. The charging roller 52 is brought into pressure contact with the surface of the photosensitive member 51 and is rotated followingly as the photosensitive member 51 is rotated.

When the charging roller is used, the charging process may preferably be performed under conditions of a roller contact pressure of 5 to 500 g/cm, and an AC voltage of 0.5 to 5 kVpp, an AC frequency of 50 Hz to 5 kHz and a DC voltage of ±0.2 to ±1.5 kV when a voltage formed by superimposing an AC voltage on a DC voltage, and a DC voltage of from ±0.2 to ±5 kV when a DC voltage is used.

As a charging means other than the charging roller, there is a method making use of a charging blade and a method making use of a conductive brush. These contact charging means have the effect of, e.g., making high voltage unnecessary and making ozone less occur.

The charging roller and charging blade as contact charging means may preferably be made of a conductive rubber, and a release coat may be provided on its surface. The release coat may be formed of a nylon resin, PVDF (polyvinylidene fluoride) or PVDC (polyvinylidene chloride), any of which may be used.

The toner image on the photosensitive member 51 is transferred to an intermediate transfer member 55 to which a voltage (e.g., ±0.1 to ±5 kV) is applied. The surface of the photosensitive member 51 is cleaned by a cleaning means 59 having a cleaning blade 58.

The intermediate transfer member 55 is comprised of a pipe-like conductive mandrel 55*b* and a medium-resistance elastic material layer 55*a* formed on its periphery. The mandrel 55*b* may comprise a plastic pipe provided thereon with a conductive coating.

The medium-resistance elastic material layer 55*a* is a solid or foamed-material layer made of an elastic material such as silicone rubber, fluorine rubber, chloroprene rubber, urethane rubber or EPDM (ethylene-propylene-diene terpolymer) in which a conductivity-providing agent such as carbon black, zinc oxide, tin oxide or silicon carbide has been mixed and dispersed to adjust electrical resistance value (volume resistivity) to a medium resistance of from $10^5$ to $10^{11}$ Ω·cm.

The intermediate transfer member 55 is provided in contact with the bottom part of the photosensitive member 51, being axially supported in parallel to the photosensitive member 51, and is driven rotatingly at the same peripheral speed as the photosensitive member 51 in the anti-clockwise direction as shown by an arrow.

The first-color toner image formed and held on the surface of the photosensitive member 51 is, in the course where it is passed through the transfer nip portion where the photosensitive member 51 and the intermediate transfer member 55 come into contact, transferred intermediately sequencially to the periphery of the intermediate transfer member 55 by the aid of the electric filed formed at the transfer nip portion by a transfer bias applied to the intermediate transfer member 55.

If necessary, after the toner image has been transferred to the transfer medium, the surface of the intermediate transfer member 55 may be cleaned by a cleaning means 500 which can become contact with or separate from it. When the toner is present on the intermediate transfer member 55, the cleaning means 500 is separated from the surface of the intermediate transfer member so that the toner image is not disturbed.

A transfer means 57 is provided in contact with the bottom part of the intermediate transfer member 55, being axially supported in parallel to the intermediate transfer member 55. As the transfer means 57, for example a transfer roller or a transfer belt may be used. In the apparatus shown in FIG. 4, a transfer roller is used. The transfer means 57 may be so provided that it comes into direct contact with the intermediate transfer member 55, or may be so disposed that a belt or the like comes into contact with, and between, the intermediate transfer member 55 and the transfer means 57.

In the case of the transfer roller, it is constituted basically of a mandrel 57*b* at the center and a conductive elastic layer 57*a* that forms the periphery of the former.

The intermediate transfer member and the transfer roller may be formed of commonly available materials. The elastic layer of the transfer roller may be made to have a volume resistivity set smaller than the volume resistivity of the elastic layer of the intermediate transfer member, whereby the voltage applied to the transfer roller can be lessened, good toner images can be formed on the transfer medium and also the transfer medium can be prevented from being wound around the intermediate transfer member. In particular, the elastic layer of the intermediate transfer member may preferably have a volume resistivity at least 10 times the volume resistivity of the elastic layer of the transfer roller.

The hardness of the intermediate transfer member and transfer roller is measured according to JIS K-6301. The intermediate transfer member used in the present invention may preferably be constituted of an elastic layer with a hardness in the range of from 10 to 40 degrees. As for the hardness of the transfer roller, the transfer roller may preferably have an elastic layer with a hardness higher than the hardness of the elastic layer of the intermediate transfer member and has a value of from 41 to 80 degrees, in order to prevent the transfer medium from being wound around the intermediate transfer member. If the intermediate transfer member and the transfer roller have a reverse hardness, a concave may be formed on the transfer roller side to tend to cause the transfer medium to wind around the intermediate transfer member.

The transfer means 57 is rotated at a speed equal to, or made different from, the peripheral speed of the intermediate transfer member 55. The transfer medium 56 is transported between the intermediate transfer member 55 and the transfer means 57 and simultaneously a bias with a polarity reverse to that of the triboelectric charge the toner has is applied to the transfer means 57 from a transfer bias applying means, so that the toner image on the intermediate transfer member 55 is transferred to the surface side of the transfer medium 56.

A rotating member for transfer may be made of the same material as used in the charging roller. The transfer process may preferably be performed under conditions of a roller contact pressure of 4.9 to 490 N/m (5 to 500 g/cm) and a DC voltage of ±0.2 to ±10 kV.

For example, a conductive elastic layer 57*b* of the transfer roller is made of an elastic material having a volume resistivity of about $10^6$ to $10^{10}$ Ω·cm, e.g., a polyurethane, or an ethylene-propylene-diene type terpolymer (EPDM), with a conductive material such as carbon dispersed therein. A bias is applied to a mandrel 57*a* by a constant voltage power source. As bias conditions, a voltage of from ±0.2 to ±10 kV is preferred.

Subsequently, the transfer medium 56 is transported to a fixing assembly 501 constituted basically of a heat roller provided internally with a heating element such as a halogen heater and an elastic material pressure roller brought into contact therewith under pressure, and is passed between the heat roller and the pressure roller, thus the toner image is heat-and-pressure fixed to the transfer medium. Another method may also be used in which the toner image is fixed by a heater through a film.

A one-component developing method is described below. The toner according to the present invention may be applied in one-component developing methods such as a magnetic one-component developing method and a non-magnetic one-component developing method.

First, magnetic one-component development will be described with reference to FIG. 5.

Figure 5:
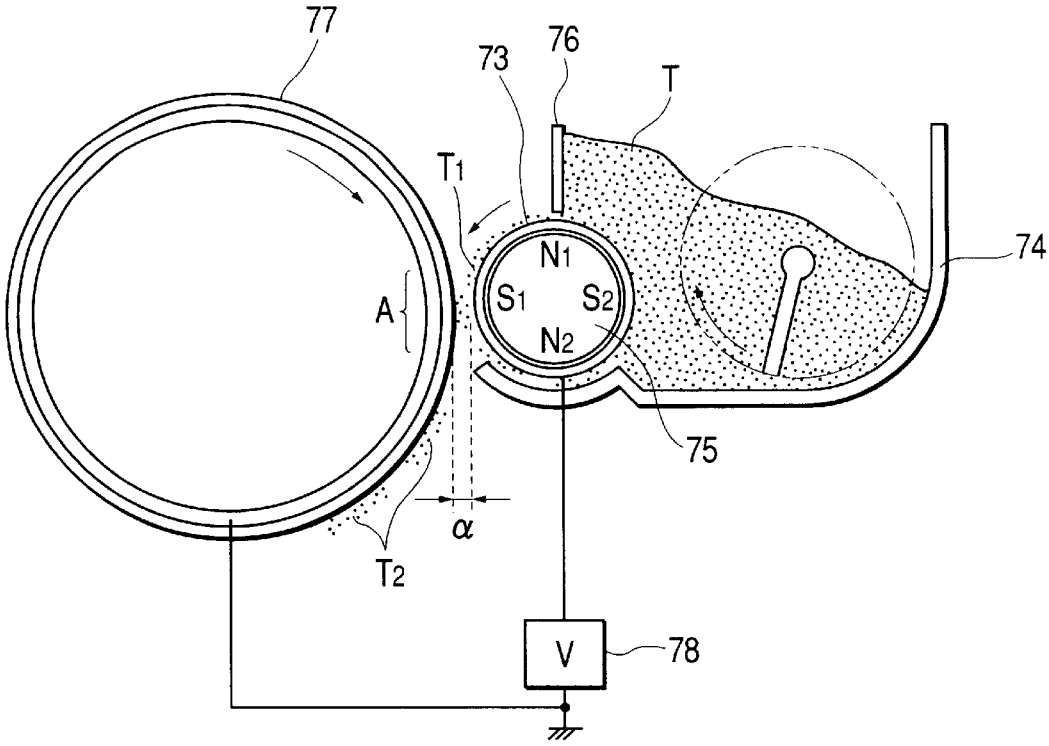
FIG. 5 is a schematic view showing a magnetic one-component developing assembly.

As shown in FIG. 5, substantially the right-half periphery of a developing sleeve 73 always comes in contact with the toner stock inside a toner container 74. The toner in the vicinity of the surface of the developing sleeve 73 is attracted to and carried on the surface of the developing sleeve by the action of magnetic force and/or electrostatic force, the former being produced by a magnetism generating means 75 provided in the developing sleeve. As the developing sleeve 73 is rotatingly driven, the magnetic toner layer formed on the surface of the developing sleeve 73 passes the position of a regulation member 76, in the course of which the toner is formed into a regulated layer as a thin-layer magnetic toner T1 with a uniform thickness at every portion. The magnetic toner is electrostatically charged chiefly by the frictional contact between the developing sleeve surface and the magnetic toner T standing in the vicinity thereof in the toner stock, as the developing sleeve 73 is rotated. As the developing sleeve 73 is rotated, the thin-layer surface of the magnetic toner carried on the developing sleeve 73 is moved toward the side of a latent-image-bearing member 77 and is passed through a developing zone A at which the latent-image-bearing member 77 and the developing sleeve 73 come nearest. In the course of passing the developing zone A, the magnetic toner of the magnetic toner thin layer formed on the developing sleeve 73 flies by the aid of DC and AC electric fields formed by direct current and alternating current voltages applied across the latent-image-bearing member 77 and the developing sleeve 73 by a voltage applying means 78, and reciprocates (at a gap α) between the surface of the latent-image-bearing member 77 and the surface of the developing sleeve 73. Finally, the magnetic toner on the side of the developing sleeve 73 is selectively transferred and attracted to the surface of the latent-image-bearing member 77 in accordance with potential patterns of electrostatic latent images, so that toner images T2 are successively formed.

The surface of the developing sleeve 73, having passed the developing zone A and from which the magnetic toner has been selectively consumed, is returned to the toner stock in the toner container (hopper) 74, so that it is again supplied with the magnetic toner and the magnetic toner thin layer T1 carried on the developing sleeve 73 is transported to the developing zone A. In this way, the step of development is repeated.

The regulation member 76 serving as a toner thin-layer forming means used in the assembly shown in FIG. 5 is a doctor blade such as a metallic blade or a magnetic blade provided leaving a certain gap between it and the developing sleeve 73. Alternatively, in place of the doctor blade, a roller formed of metal, resin or ceramic may be used. Also, as the toner thin-layer forming regulation member, an elastic blade or elastic roller may also be used which elastically comes into touch with the surface of the developing sleeve (toner carrying member) by elastic force.

As materials for forming the elastic blade or elastic roller, it is possible to use rubber elastic materials such as silicone rubber, urethane rubber and NBR; synthetic resin elastic materials such as polyethylene terephthalate, or metal elastic materials such as stainless steel, steel and phosphor bronze, as well as composite materials thereof. The part coming into touch with the sleeve may preferably be made of the rubber elastic material or resin elastic material.

Figure 6:
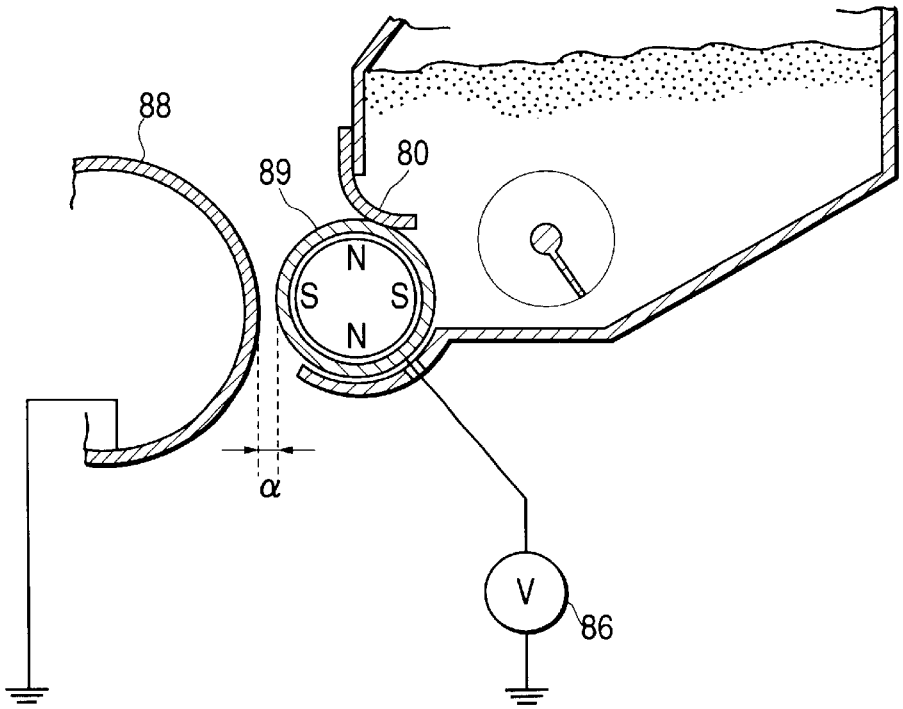
FIG. 6 is a schematic view showing another magnetic one-component developing assembly.

An example in which the elastic blade is used is shown in FIG. 6.

An elastic blade 80 is, at its upper side base portion, fixedly held on the side of a developer container and is so provided that its blade inner face side (or its outer face side in the case of the reverse direction) is, at its lower side, brought into touch with the surface of a developing sleeve 89 under an appropriate elastic pressure in such a state that it is deflected against the elasticity of the blade 80 in the forward direction or backward direction of the rotation of the developing sleeve 89. According to such construction, a toner layer can be formed which is thin and dense, being more stably even against environmental variations.

In the case of the magnetic one-component development, it is effective for the elastic blade 80 to be brought into touch with the developing sleeve 89 at a pressure of 98 N/m (0.1 kg/m) or above, preferably from $2.9\times10^2$ to $2.5\times10^4$ N/m (0.3 to 25 kg/m, and more preferably from $4.9\times10^2$ to $1.2\times10^4$ N/m (0.5 to 12 kg/cm), as a linear pressure in the generatrix direction of the sleeve. The gap $\alpha$ between a latent-image-bearing member 88 and the developing sleeve 89 may preferably be set to be, e.g., from 50 to 500 $\mu$m. The layer thickness of the magnetic toner layer formed on the developing sleeve 89 may most preferably be made smaller than the gap $\alpha$ between the latent-image-bearing member 88 and the developing sleeve 89. In some cases, the layer thickness of the magnetic toner layer may be regulated in such an extent that part of a large number of ears of the magnetic toner constituting the magnetic toner layer comes into contact with the surface of the latent-image-bearing member 88.

The developing sleeve 89 is rotated at a peripheral speed of from 100 to 200% with respect to the latent-image-bearing member 88. The alternating bias voltage applied by a voltage applying means 86 may preferably be applied at a peak-to-peak voltage of 0.1 kV or above, preferably from 0.2 to 3.0 kV, and more preferably from 0.3 to 2.0 kV. The alternating bias may be applied at a frequency of from 0.5 to 5.0 kHz, preferably from 1.0 to 3.0 kHz, and more preferably from 1.5 to 3.0 kHz. As the waveform of the alternating bias, rectangular waveform, sine waveform, saw-tooth waveform and triangle waveform may be used. An asymmetrical AC bias having different time for which forward/backward voltages are applied may also be used. It is also preferable to superimpose a DC bias.

Figure 7:
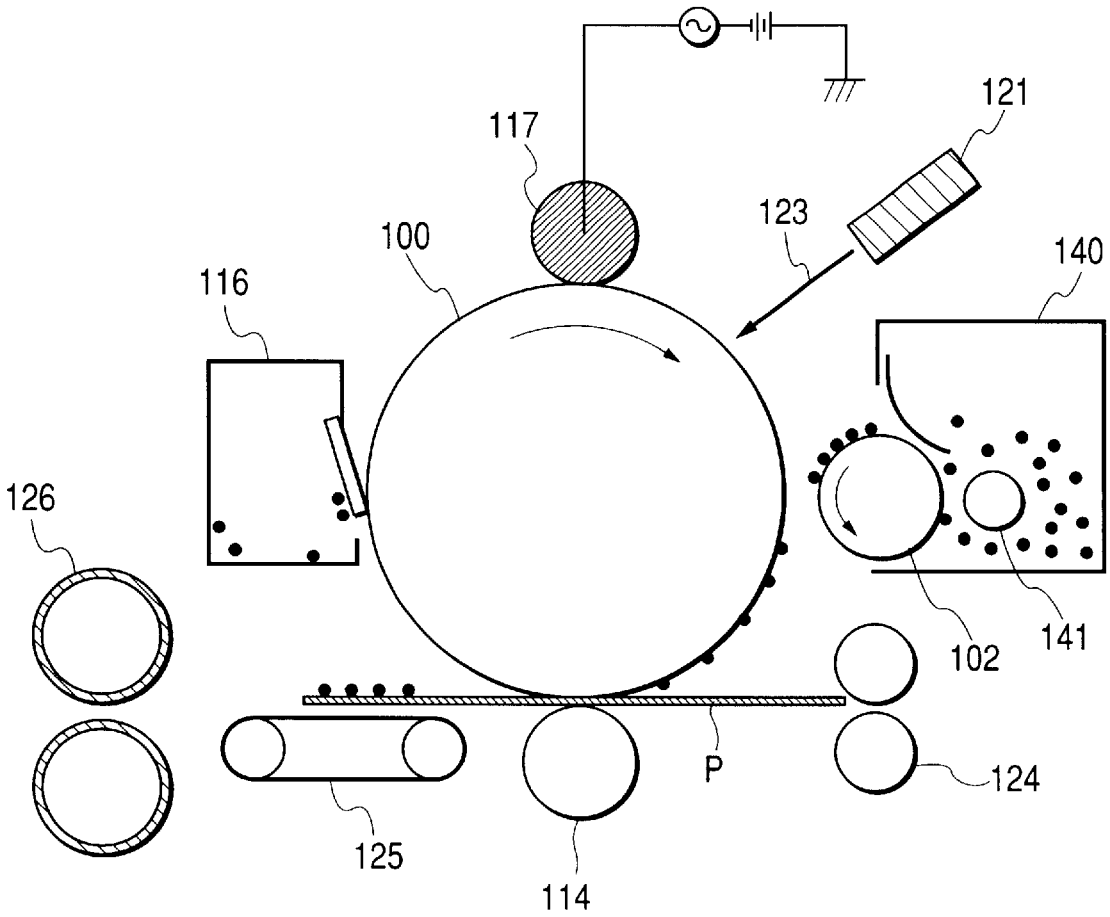
FIG. 7 is a schematic view showing still another magnetic one-component developing assembly.

FIG. 7 shows another example of the magnetic one-component developing method. In FIG. 7, reference numeral 100 denotes a photosensitive member (drum), around which provided are a primary charging roller 117, a developing assembly 140 having an agitation member 141, a transfer charging roller 114, a cleaner 116, a registration roller 124 and so forth. Then, the photosensitive member 100 is electrostatically charged by means of the primary charging roller 117. Then, the photosensitive member 100 is exposed by irradiating it with laser light 123 by means of a laser generator 121. An electrostatic latent image formed on the photosensitive member 100 is developed by means of the developing assembly 140 with its toner carried on a developing sleeve 102. Thus a toner image is formed, which is then transferred to a transfer medium P by means of a transfer roller 114 brought into contact with the photosensitive member via the transfer medium P. The transfer medium P holding the toner image thereon is transported to a fixing assembly 126 by a transport belt 125, and the toner image is fixed onto the transfer medium P. Also, the toner left partly on the photosensitive member is removed by the cleaner 116 (cleaning means) to clean the surface.

In the developing zone, DC and AC developing biases are applied across the photosensitive member 100 and the developing sleeve 102. The toner on the developing sleeve 102 flies onto the photosensitive member 100 in accordance with the electrostatic latent image to form a visible image.

Particle size distribution of the polymerization toner according to the present invention is measured in the following way.

Measurement of particle size distribution of toner:

As a measuring device, Coulter counter Model TA-II or Coulter Multisizer (manufactured by Coulter Electronics, Inc.) is used. As an electrolytic solution, an aqueous 1% NaCl solution is prepared using first-grade sodium chloride. For example, ISOTON R-II (trade name, manufactured by Coulter Scientific Japan Co.) may be used. Measurement is made by adding as a dispersant 0.1 to 5 ml of a surface active agent, preferably an alkylbenzene sulfonate, to 100 to 150 ml of the above aqueous electrolytic solution, and further adding 2 to 20 mg of a sample to be measured. The electrolytic solution in which the sample has been suspended is subjected to dispersion for about 1 minute to about 3 minutes in an ultrasonic dispersion machine. The volume distribution and number distribution of the toner are calculated by measuring the volume and number of toner particles by means of the Coulter Multisizer for each channel, using an aperture of 100 $\mu$m as its aperture. Then the weight-based, weight average particle diameter (D4: the middle value of each channel is used as the representative value for each channel) determined from the volume distribution of toner particles is determined.

As channels, 13 channels are used, which are channels of 2.00 to 2.52 $\mu$m, 2.52 to 3.17 $\mu$m, 3.17 to 4.00 $\mu$m, 4.00 to 5.04 $\mu$m, 5.04 to 6.35 $\mu$m, 6.35 to 8.00 $\mu$m, 8.00 to 10.08 $\mu$m, 10.08 to 12.70 $\mu$m, 12.70 to 16.00 $\mu$m, 16.00 to 20.20 $\mu$m, 20.20 to 25.40 $\mu$m, 25.40 to 32.00 $\mu$m, and 32.00 to 40.30 $\mu$m.

EXAMPLES

The present invention is described below in greater detail by giving Examples and Comparative Examples.

Example A-1

An aqueous dispersion medium and a polymerizable-monomer composition were each prepared in the following way.

Preparation of Aqueous Dispersion Medium:

In a vessel having an internal volume of 200 liters, the following components were mixed. The mixture obtained was heated to 65° C. and thereafter stirred at a number of revolutions of 3,300 r.p.m. (throughput: 240 liters/sec.) by means of a high-speed rotary-shearing stirrer CLEAR MIX CLM-30S (manufactured by M. Technique K.K.; maximum length of a rotor used: 165 mm; clearance: 0.5 mm).

| | (by weight) |
|---|---|
| Water | 950 parts |
| Aqueous 0.1 mol/liter $Na_3PO_4$ solution | 450 parts |

Next, the inside of the vessel was displaced with nitrogen and at the same time 68 parts by weight of an aqueous 1.0 mol/liter $CaCl_2$ solution was added therein to carry out reaction to obtain an aqueous dispersion medium containing fine particles of calcium phosphate.

Preparation of Polymerizable-monomer Composition:

| | (by weight) |
|---|---|
| Styrene | 150 parts |
| 2-Ethylhexyl acrylate | 20 parts |
| Colorant (C.I. Pigment Yellow 13) | 12 parts |
| Di-t-butylsalicylic acid metal compound | 2 parts |
| Polyester resin (acid value: 5 mg · KOH/g; peak molecular weight: 7,000) | 15 parts |
| Ester wax (melting point: 65° C.) | 30 parts |
| Divinylbenzene | 0.8 part |

Among the above components, the components other than the ester wax were mixed, and the mixture obtained was dispersed for 3 hours by means of an attritor (manufactured by Mitsui Miike Engineering Corporation), and thereafter the ester wax was added, which were then heated to 65° C. and mixed for 1 hour to obtain a polymerizable-monomer composition.

The number of revolutions of the high-speed rotary-shearing stirrer CLEAR MIX CLM-30S holding therein the aqueous dispersion medium prepared as described above was set at 3,300 r.p.m. (throughput: 240 liters/sec.), and the polymerizable-monomer composition prepared as described above was introduced into the stirrer to start granulation. On lapse of 5 minutes after the start of granulation, a solution prepared by dissolving 7 parts by weight of 2,2'-azobis(2,4-dimethylvaleronitrile) as a polymerization initiator in 30 parts by weight of styrene was added over a period of 20 seconds as the time taken to add the polymerization initiator (hereinafter "polymerization initiator addition time"). At the time the polymerization initiator was begun to be added, the particles of the polymerizable monomer composition had a particle diameter of 120% of that of the particles formed at the time the granulation was completed. The granulation was continued also after the polymerization initiator was added, and the granulation was carried out for 15 minutes in total. Here, the total weight of the aqueous dispersion medium and polymerizable-monomer composition was 173.5 kg and the specific gravity was 1.1, and therefore the value of T×N was 30.4. This reaction mixture was moved into a vessel of a stirrer having a propeller stirring blade and, setting its number of revolutions at 50 r.p.m., the polymerization was continued at an internal temperature of 65° C. After 6 hours, the polymerization temperature was raised to 80° C., and the heating and stirring were continued for 5 hours to complete polymerization. After the polymerization reaction was completed, residual monomers were evaporated off under reduced pressure, and the resultant mixture was cooled. Thereafter, dilute hydrochloric acid was added therein to dissolve the dispersant calcium phosphate, followed by solid-liquid separation, water washing, filtration and drying to obtain polymerization toner particles (yellow toner particles).

Any contamination of the polymerizable-monomer composition preparation vessel, granulation vessel and polymerization reaction vessel was examined after the production of the toner particles, where no great contamination was seen. The above process was repeated to carry out continuous 20-batch production to examine the extent of contamination of the vessels, where any scales were seen to have little adhered in all the vessels.

With regard to the toner particles thus obtained, their particle size distribution was measured with Coulter Multisizer to reveal that they had a weight-average particle diameter of 5.9 $\mu$m and contained 30% by number of 4.0 $\mu$m or smaller diameter particles and 1.5% by volume of 10.1 $\mu$m or larger diameter particles, having a small particle diameter and also a very sharp particle size distribution. The content of particles smaller than 2.0 $\mu$m diameter was also measured with a flow type particle image analyzer FPIA-1000 to find that it was 30% by number and the fine particles were in a small content.

Cross sections of the above yellow toner particles were observed by TEM (transmission electron microscopy) to confirm that the release agent ester wax was well encapsulated with the shell resin as shown in FIG. 1.

100 parts by weight of the yellow toner particles obtained and 1.5 parts by weight of hydrophobic fine titanium oxide powder having a specific surface area of 100 $m^2/g$ as measured by the BET method were blended to obtain a negatively triboelectrically chargeable yellow toner.

With 5 parts by weight of this yellow toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil application mechanism of the fixing assembly was detached), a yellow toner 10,000-sheet continuous paper feed test (running test) was made in a high-temperature high-humidity environment (30° C., 80% RH). Toner's physical properties and results of evaluation are shown in Table 1 [Table 1(A)-1(B)].

Example A-2

Cyan toner particles were obtained in the same manner as in Example A-1 except that the colorant was changed to C.I. Pigment Blue 15:3 and the polymerization initiator addition time was changed to 100 seconds.

With regard to the toner particles thus obtained, their particle size distribution was measured with Coulter Multisizer to reveal that they had a weight-average particle diameter of 6.2 $\mu$m and contained 28% by number of 4.0 $\mu$m or smaller diameter particles and 1.9% by volume of 10.1 $\mu$m or larger diameter particles, having a small particle diameter and also a very sharp particle size distribution. The content of particles smaller than 2.0 $\mu$m diameter was also measured with a flow type particle image analyzer FPIA-1000 to find that it was 25% by number and the fine particles were in a small content.

Cross sections of the above cyan toner particles were observed by TEM to confirm that the release agent ester wax was well encapsulated with the shell resin as shown in FIG. 1.

Any contamination of the polymerizable-monomer composition preparation vessel, granulation vessel and polymerization reaction vessel was examined after the production of the toner particles, where no great contamination was seen. The above process was repeated to carry out continuous 20-batch production to examine the extent of contamination of the vessels, where any scales were seen to have little adhered in all the vessels.

100 parts by weight of the cyan toner particles obtained and 1.5 parts by weight of hydrophobic fine titanium oxide powder having a specific surface area of 100 $m^2/g$ as measured by the BET method were blended to obtain a negatively triboelectrically chargeable cyan toner.

With 5 parts by weight of this cyan toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil application mechanism of the fixing assembly was detached), a cyan toner 10,000-sheet continuous paper feed test (running test) was made in the high-temperature high-humidity environment. Toner's physical properties and results of evaluation are shown in Table 1.

Example A-3

Magenta toner particles were obtained in the same manner as in Example A-1 except that the colorant was changed to C.I. Pigment Red 122 and the polymerization initiator addition time was changed to 200 seconds.

With regard to the toner particles thus obtained, their particle size distribution was measured with Coulter Multisizer to reveal that they had a weight-average particle diameter of 6.0 μm and contained 31% by number of 4.0 μm or smaller diameter particles and 1.5% by volume of 10.1 μm or larger diameter particles, having a small particle diameter and also a very sharp particle size distribution. The content of particles smaller than 2.0 μm diameter was also measured with a flow type particle image analyzer FPIA-1000 to find that it was 35% by number.

Cross sections of the above magenta toner particles were observed by TEM to confirm that the release agent ester wax was well encapsulated with the shell resin as shown in FIG. 1.

Any contamination of the polymerizable-monomer composition preparation vessel, granulation vessel and polymerization reaction vessel was examined after the production of the toner particles, where no great contamination was seen. The above process was repeated to carry out continuous 20-batch production to examine the extent of contamination of the vessels, where any scales were seen to have little adhered in all the vessels.

100 parts by weight of the magenta toner particles obtained and 1.5 parts by weight of hydrophobic fine titanium oxide powder having a specific surface area of 100 $m^2/g$ as measured by the BET method were blended to obtain a negatively triboelectrically chargeable magenta toner.

With 5 parts by weight of this magenta toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil application mechanism of the fixing assembly was detached), a magenta toner 10,000-sheet continuous paper feed test (running test) was made in the high-temperature high-humidity environment. Toner's physical properties and results of evaluation are shown in Table 1.

Example A-4

Black toner particles were obtained in the same manner as in Example A-1 except that the colorant was changed to carbon black and the polymerization initiator addition time was changed to 5 seconds.

With regard to the toner particles thus obtained, their particle size distribution was measured with Coulter Multisizer to reveal that they had a weight-average particle diameter of 6.5 μm and contained 31% by number of 4.0 μm or smaller diameter particles and 1.5% by volume of 10.1 μm or larger diameter particles, having a small particle diameter and also a very sharp particle size distribution. The content of particles smaller than 2.0 μm diameter was also measured with a flow type particle image analyzer FPIA-1000 to find that it was 37% by number.

Cross sections of the above black toner particles were observed by TEM to confirm that the release agent ester wax was well encapsulated with the shell resin as shown in FIG. 1.

Any contamination of the polymerizable-monomer composition preparation vessel, granulation vessel and polymerization reaction vessel was examined after the production of the toner particles, where no great contamination was seen. The above process was repeated to carry out continuous 10-batch production to examine the extent of contamination of the vessels, where any scales were seen to have little adhered in all the vessels, but, as a result of further continuous production up to 15 batches in total, a slight contamination was observable.

100 parts by weight of the black toner particles obtained and 1.5 parts by weight of hydrophobic fine titanium oxide powder having a specific surface area of 100 $m^2/g$ as measured by the BET method were blended to obtain a negatively triboelectrically chargeable black toner.

With 5 parts by weight of this black toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil application mechanism of the fixing assembly was detached), a black toner 10,000-sheet continuous paper feed test (running test) was made in the high-temperature high-humidity environment. Toner's physical properties and results of evaluation are shown in Table 1.

Example A-5

Magnetic toner particles were obtained in the same manner as in Example A-1 except that the colorant was changed to 140 parts by weight of a magnetic material having been hydrophobic-treated with a silane coupling agent and having an average particle diameter of 0.2 μm, the number of revolutions of the stirrer was changed to 3,000 r.p.m. (throughput: 218 liters/sec.) and the polymerization initiator addition time was changed to 30 seconds. Here, the total weight of the aqueous dispersion medium and polymerizable-monomer composition was 186.3 kg and the specific gravity was 1.4, and therefore the value of T ×N was 49.1.

With regard to the toner particles thus obtained, their particle size distribution was measured with Coulter Multisizer to reveal that they had a weight-average particle diameter of 6.3 μm and contained 28% by number of 4.0 μm or smaller diameter particles and 1.8% by volume of 10.1 μm or larger diameter particles, having a small particle diameter and also a very sharp particle size distribution. The content of particles smaller than 2.0 μm diameter was also measured with a flow type particle image analyzer FPIA-1000 to find that it was 32% by number.

Any contamination of the polymerizable-monomer composition preparation vessel, granulation vessel and polymerization reaction vessel was examined after the production of the toner particles, where no great contamination was seen. The above process was repeated to carry out continuous 20-batch production to examine the extent of contamination of the vessels, where any scales were seen to have little adhered in all the vessels.

100 parts by weight of the magnetic toner particles obtained and 1.5 parts by weight of hydrophobic fine titanium oxide powder having a specific surface area of 100 $m^2/g$ as measured by the BET method were blended to obtain a negatively triboelectrically chargeable magnetic toner.

Using this magnetic toner and using the magnetic one-component developing system shown in FIG. 7, a 10,000-sheet continuous paper feed test (running test) was made in the high-temperature high-humidity environment. Toner's physical properties and results of evaluation are shown in Table 1.

Example A-6

Yellow toner particles were obtained in the same manner as in Example A-1 except that the polymerization initiator was changed to benzoyl peroxide and the reaction temperature was set at 70° C. and raised to 85° C. after 6 hours.

With regard to the toner particles thus obtained, their particle size distribution was measured with Coulter Multisizer to reveal that they had a weight-average particle diameter of 6.1 μm and contained 30% by number of 4.0 μm or smaller diameter particles and 1.8% by volume of 10.1 μm or larger diameter particles, having a small particle diameter and also a very sharp particle size distribution. The content of particles smaller than 2.0 μm diameter was also measured with a flow type particle image analyzer FPIA-1000 to find that it was 27% by number.

Cross sections of the above yellow toner particles were observed by TEM to confirm that the release agent ester wax was well encapsulated with the shell resin as shown in FIG. 1.

Any contamination of the polymerizable-monomer composition preparation vessel, granulation vessel and polymerization reaction vessel was examined after the production of the toner particles, where no great contamination was observable. The above process was repeated to carry out continuous 20-batch production to examine the extent of contamination of the vessels, where any scales were seen to have little adhered in all the vessels.

100 parts by weight of the yellow toner particles obtained and 1.5 parts by weight of hydrophobic fine titanium oxide powder having a specific surface area of 100 $m^2/g$ as measured by the BET method were blended to obtain a negatively triboelectrically chargeable yellow toner.

With 5 parts by weight of this yellow toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil application mechanism of the fixing assembly was detached), a yellow toner 10,000-sheet continuous paper feed test (running test) was made in the high-temperature high-humidity environment. Toner's physical properties and results of evaluation are shown in Table 1.

Example A-7

Yellow toner particles were obtained in the same manner as in Example A-1 except that the timing to add the polymerization initiator was changed to 1 minute after the granulation was started. At the time the polymerization initiator was begun to be added, the particles of the polymerizable monomer composition had a particle diameter of 1,200% of that of the particles formed at the time the granulation was completed.

With regard to the toner particles thus obtained, their particle size distribution was measured with Coulter Multisizer to reveal that they had a weight-average particle diameter of 6.1 μm and contained 28% by number of 4.0 μm or smaller diameter particles and 1.7% by volume of 10.1 μm or larger diameter particles, having a small particle diameter and also a very sharp particle size distribution. The content of particles smaller than 2.0 μm diameter was also measured with a flow type particle image analyzer FPIA-1000 to find that it was 31% by number.

Any contamination of the polymerizable-monomer composition preparation vessel, granulation vessel and polymerization reaction vessel was examined after the production of the toner particles, where no great contamination was seen. The above process was repeated to carry out continuous 15-batch production to examine the extent of contamination of the vessels, where any scales were seen to have little adhered in all the vessels, but, as a result of further continuous production up to 20 batches in total, a slight contamination was observable.

100 parts by weight of the yellow toner particles obtained and 1.5 parts by weight of hydrophobic fine titanium oxide powder having a specific surface area of 100 $m^2/g$ as measured by the BET method were blended to obtain a negatively triboelectrically chargeable yellow toner.

With 5 parts by weight of this yellow toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil application mechanism of the fixing assembly was detached), a yellow toner 10,000-sheet continuous paper feed test (running test) was made in the high-temperature high-humidity environment. Toner's physical properties and results of evaluation are shown in Table 1. This toner slightly caused fog as a result of running. This was presumed to be due to a broad molecular-weight distribution between toner particles.

Example A-8

Yellow toner particles were obtained in the same manner as in Example A-1 except that the timing to add the polymerization initiator was changed to 12 minutes after the granulation was started. At the time the polymerization initiator was begun to be added, the particles of the polymerizable monomer composition had a particle diameter of 102% of that of the particles formed at the time the granulation was completed.

With regard to the toner particles thus obtained, their particle size distribution was measured with Coulter Multisizer to reveal that they had a weight-average particle diameter of 5.7 μm and contained 35% by number of 4.0 μm or smaller diameter particles and 1.5% by volume of 10.1 μm or larger diameter particles, having a small particle diameter and also a very sharp particle size distribution. The content of particles smaller than 2.0 μm diameter was also measured with a flow type particle image analyzer FPIA-1000 to find that it was 39% by number.

Any contamination of the polymerizable-monomer composition preparation vessel, granulation vessel and polymerization reaction vessel was examined after the production of the toner particles, where no great contamination was seen. The above process was repeated to carry out continuous 10-batch production to examine the extent of contamination of the vessels, where any scales were seen to have little adhered in all the vessels, but, as a result of further continuous production up to 13 batches in total, a slight contamination was observable.

100 parts by weight of the yellow toner particles obtained and 1.5 parts by weight of hydrophobic fine titanium oxide powder having a specific surface area of 100 $m^2/g$ as measured by the BET method were blended to obtain a negatively triboelectrically chargeable yellow toner.

With 5 parts by weight of this yellow toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil application mechanism of the fixing assembly was detached), a yellow toner 10,000-sheet continuous paper feed test (running test) was made in the high-temperature high-humidity environment. Toner's physical properties and results of evaluation are shown in Table 1. This toner slightly caused a decrease in image density as a result of running. This was presumed to be due to fine particles of the toner which were in a large quantity in its particle size distribution.

Example A-9

Using the toner of Example A-1 and using the non-magnetic one-component developing system as shown in FIG. 4, a 5,000-sheet continuous paper feed test (running test) was made in the high-temperature high-humidity environment. As the result, images with less fog and a stable image density were obtained.

Comparative Example A-1

An aqueous dispersion medium and a polymerizable-monomer composition were each prepared in the following way.

Preparation of Aqueous Dispersion Medium:

In a vessel having an internal volume of 200 liters, the following components were mixed. The mixture obtained was heated to 65° C. and thereafter stirred at a number of revolutions of 3,300 r.p.m. (throughput: 240 liters/sec.) by means of a high-speed rotary-shearing stirrer CLEAR MIX CLM-30S (manufactured by M. Technique K.K.; maximum length of a rotor used: 165 mm; clearance: 0.5 mm).

| | (by weight) |
|---|---|
| Water | 950 parts |
| Aqueous 0.1 mol/liter $Na_3PO_4$ solution | 450 parts |

Next, the inside of the vessel was displaced with nitrogen and at the same time 68 parts by weight of an aqueous 1.0 mol/liter $CaCl_2$ solution was added therein to carry out reaction to obtain an aqueous dispersion medium containing fine particles of calcium phosphate.

Preparation of Polymerizable-monomer Composition:

| | (by weight) |
|---|---|
| Styrene | 180 parts |
| 2-Ethylhexyl acrylate | 20 parts |
| Colorant (C.I. Pigment Yellow 13) | 12 parts |
| Di-t-butylsalicylic acid metal compound | 2 parts |
| Polyester resin (acid value: 5 mg · KOH/g; peak molecular weight: 7,000) | 15 parts |
| Ester wax (melting point: 65° C.) | 30 parts |
| Divinylbenzene | 0.8 part |

Among the above components, the components other than the ester wax were mixed, and the mixture obtained was dispersed for 3 hours by means of an attritor (manufactured by Mitsui Miike Engineering Corporation), and thereafter the ester wax was added, which were then heated to 65° C. and mixed for 1 hour to obtain a polymerizable-monomer composition.

The number of revolutions of the high-speed rotary-shearing stirrer CLEAR MIX CLM-30S holding therein the aqueous dispersion medium prepared as described above was set at 3,300 r.p.m. (throughput: 240 liters/sec.), and the polymerizable-monomer composition prepared as described above was introduced into the stirrer to start granulation. Five minutes after the start of granulation, 7 parts by weight of 2,2'-azobis(2,4-dimethylvaleronitrile) as a polymerization initiator was added. Here, the polymerization initiator addition time was 1 second. The granulation was continued also thereafter, and the granulation was carried out for 15 minutes in total. Here, the total weight of the aqueous dispersion medium and polymerizable-monomer composition was 173.5 kg and the specific gravity was 1.1, and therefore the value of T×N was 1.5. This reaction mixture was moved into a vessel of a stirrer having a propeller stirring blade and, setting its number of revolutions at 50 r.p.m., the polymerization was continued at an internal temperature of 65° C. After 6 hours, the polymerization temperature was raised to 80° C., and the heating and stirring were continued for 5 hours to complete polymerization. After the polymerization reaction was completed, residual monomers were evaporated off under reduced pressure, and the resultant mixture was cooled. Thereafter, dilute hydrochloric acid was added therein to dissolve the dispersant calcium phosphate, followed by solid-liquid separation, water washing, filtration and drying to obtain polymerization toner particles (yellow toner particles).

With regard to the toner particles thus obtained, their particle size distribution was measured with Coulter Multisizer to reveal that they had a weight-average particle diameter of 6.7 $\mu$m and contained 28% by number of 4.0×m or smaller diameter particles and 2.1% by volume of 10.1 $\mu$m or larger diameter particles, having a small particle diameter and also a very sharp particle size distribution. The content of particles smaller than 2.0 $\mu$m diameter was also measured with a flow type particle image analyzer FPIA-1000 to find that it was 29% by number and the fine particles were in a small content.

Cross sections of the above yellow toner particles were observed by TEM to confirm that the release agent ester wax was well encapsulated with the shell resin as shown in FIG. 1.

Any contamination of the polymerizable-monomer composition preparation vessel, granulation vessel and polymerization reaction vessel was examined after the production of the toner particles, where contamination was seen. The above process was repeated to carry out continuous 10-batch production to examine the extent of contamination of the vessels, where scales were seen to have greatly adhered in all the vessels.

100 parts by weight of the yellow toner particles obtained and 1.5 parts by weight of hydrophobic fine titanium oxide powder having a specific surface area of 100 $m^2/g$ as measured by the BET method were blended to obtain a negatively triboelectrically chargeable yellow toner.

With 5 parts by weight of this yellow toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil application mechanism of the fixing assembly was detached), a yellow toner 10,000-sheet continuous paper feed test (running test) was made in the high-temperature high-humidity environment. Toner's physical properties and results of evaluation are shown in Table 1.

This toner showed a little high degree of agglomeration, caused fog a little seriously from the initial stage and came to cause the fog greatly with progress of running. It also had a little poor anti-offset properties.

Comparative Example A-2

Yellow toner particles were obtained in the same manner as in Example A-1 except that the polymerization initiator addition time was changed to 360 seconds.

With regard to the toner particles thus obtained, their particle size distribution was measured with Coulter Multisizer to reveal that they had a weight-average particle diameter of 6.9 μm and contained 30% by number of 4.0 μm or smaller diameter particles and 2.9% by volume of 10.1 μm or larger diameter particles, having a small particle diameter and also a very sharp particle size distribution. The content of particles smaller than 2.0 μm diameter was also measured with a flow type particle image analyzer FPIA-1000 to find that it was 42% by number.

Cross sections of the above yellow toner particles were observed by TEM to confirm that the release agent ester wax was well encapsulated with the shell resin as shown in FIG. 1.

Any contamination of the reaction vessel was examined after the production of the toner particles, where no great contamination was seen.

100 parts by weight of the yellow toner particles obtained and 1.5 parts by weight of hydrophobic fine titanium oxide powder having a specific surface area of 100 $m^2/g$ as measured by the BET method were blended to obtain a negatively triboelectrically chargeable yellow toner.

With 5 parts by weight of this yellow toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil application mechanism of the fixing assembly was detached), a yellow toner 10,000-sheet continuous paper feed test (running test) was made in the high-temperature high-humidity environment. Toner's physical properties and results of evaluation are shown in Table 1.

This toner showed a little high degree of agglomeration, caused fog a little seriously from the initial stage and came to cause the fog greatly with progress of running. It also had a little poor fixing performance and transparency of OHP sheet images.

Comparative Example A-3

Magnetic toner particles were obtained in the same manner as in Example A-1 except that the colorant was changed to 140 parts by weight of a magnetic material having been hydrophobic-treated with a silane coupling agent and having an average particle diameter of 0.2 μm, the number of revolutions of the stirrer was changed to 3,500 r.p.m. (throughput: 255 liters/sec.) and the polymerization initiator addition time was changed to 280 seconds. Here, the total weight of the aqueous dispersion medium and polymerizable-monomer composition was 186.3 kg and the specific gravity was 1.4, and therefore the value of T×N was 536.

With regard to the toner particles thus obtained, their particle size distribution was measured with Coulter Multisizer to reveal that they had a weight-average particle diameter of 6.2 μm and contained 35% by number of 4.0 μm or smaller diameter particles and 1.5% by volume of 10.1 μm or larger diameter particles. The content of particles smaller than 2.0 μm diameter was also measured with a flow type particle image analyzer FPIA-1000 to find that it was 40% by number.

Any contamination of the reaction vessel was examined after the production of the toner particles, where no great contamination was seen.

100 parts by weight of the magnetic toner particles obtained and 1.5 parts by weight of hydrophobic fine titanium oxide powder having a specific surface area of 100 $m^2/g$ as measured by the BET method were blended to obtain a negatively triboelectrically chargeable magnetic toner.

Using this magnetic toner and using the magnetic one-component developing system shown in FIG. 7, a 10,000-sheet continuous paper feed test (running test) was made in the high-temperature high-humidity environment. Toner's physical properties and results of evaluation are shown in Table 1.

This toner showed a little high degree of agglomeration, and also caused fog a little seriously from the initial stage. It also had a little poor fixing performance.

Comparative Example A-4

Yellow toner particles were obtained in the same manner as in Example A-1 except that the polymerization initiator addition time was changed to 4 seconds (T×N: 6.1).

With regard to the toner particles thus obtained, their particle size distribution was measured with Coulter Multisizer to reveal that they had a weight-average particle diameter of 6.6 μm and contained 29% by number of 4.0 μm or smaller diameter particles and 1.7% by volume of 10.1 μm or larger diameter particles, having a small particle diameter and also a very sharp particle size distribution. The content of particles smaller than 2.0 μm diameter was also measured with a flow type particle image analyzer FPIA-1000 to find that it was 32% by number.

Any contamination of the polymerizable-monomer composition preparation vessel, granulation vessel and polymerization reaction vessel was examined after the production of the toner particles, where contamination was seen. The above process was repeated to carry out continuous 12-batch production to examine the extent of contamination of the vessels, where scales were seen to have greatly adhered in all the vessels.

100 parts by weight of the yellow toner particles obtained and 1.5 parts by weight of hydrophobic fine titanium oxide powder having a specific surface area of 100 $m^2/g$ as measured by the BET method were blended to obtain a negatively triboelectrically chargeable yellow toner.

With 5 parts by weight of this yellow toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil application mechanism of the fixing assembly was detached), a yellow toner 10,000-sheet continuous paper feed test (running test) was made in the high-temperature high-humidity environment. Toner's physical properties and results of evaluation are shown in Table 1.

This toner showed a little high degree of agglomeration, caused fog a little seriously from the initial stage and slightly caused a decrease in image density with progress of running.

Comparative Example A-5

Yellow toner particles were obtained in the same manner as in Example A-1 except that the throughput of the stirrer was changed to 200 liters/sec. and the polymerization initiator addition time was changed to 350 seconds.

With regard to the toner particles thus obtained, their particle size distribution was measured with Coulter Multisizer to reveal that they had a weight-average particle diameter of 6.4 μm and contained 30% by number of 4.0 μm or smaller diameter particles and 1.6% by volume of 10.1 μm or larger diameter particles, having a small particle diameter and also a very sharp particle size distribution. The content of particles smaller than 2.0 μm diameter was also measured with a flow type particle image analyzer FPIA-1000 to find that it was 33% by number.

Any contamination of the polymerizable-monomer composition preparation vessel, granulation vessel and polymerization reaction vessel was examined after the production of the toner particles, where no great contamination was seen.

100 parts by weight of the yellow toner particles obtained and 1.5 parts by weight of hydrophobic fine titanium oxide powder having a specific surface area of 100 $m^2/g$ as measured by the BET method were blended to obtain a negatively triboelectrically chargeable yellow toner.

With 5 parts by weight of this yellow toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil application mechanism of the fixing assembly was detached), a yellow toner 10,000-sheet continuous paper feed test (running test) was made in the high-temperature high-humidity environment. Toner's physical properties and results of evaluation are shown in Table 1.

This toner showed a little high degree of agglomeration, caused fog a little seriously from the initial stage and slightly caused a decrease in image density with progress of running. It also had a little poor fixing performance.

Example B-1

An aqueous dispersion medium and a polymerizable-monomer composition were each prepared in the following way.

Preparation of Aqueous Dispersion Medium:

In 1,000 parts by weight of water, 10 parts by weight of magnesium carbonate was finely dispersed, and the resultant dispersion was heated to 70° C. to obtain an aqueous dispersion medium.

Preparation of polymerizable-monomer composition:

| | (by weight) |
|---|---|
| Styrene | 150 parts |
| 2-Ethylhexyl acrylate | 18 parts |
| Methyl methacrylate | 2 parts |
| Colorant (C.I. Pigment Blue 15:3) | 10 parts |
| Boron compound | 2 parts |
| Polyester resin (acid value: 10 mg · KOH/g; main peak molecular weight: 8,000) | 10 parts |
| Ester wax (melting point: 70° C.) | 20 parts |
| Divinylbenzene | 0.5 part |

The above components were heated to 70° C. and sufficiently dissolved or dispersed to prepare a polymerizable-monomer composition.

Into the aqueous dispersion medium prepared as described above, the polymerizable-monomer composition prepared as described above was introduced to carry out granulation for 10 minutes with high-speed stirring by means of a high-speed rotary-shearing stirrer CLEAR MIX CLM-30S (manufactured by M. Technique K.K.). After the granulation was completed, the granulated product was moved into a vessel of a stirrer having Max Blend Blade (manufactured by Sumitomo Heavy Industries, Ltd.), and its number of revolutions was so adjusted that the number N of pass times per unit time was twice/second. To this granulated product, a solution prepared by dissolving 5 parts by weight of a polymerization initiator 2,2'-azobis(2,4-dimethylvaleronitrile) in 30 parts by weight of styrene was added over a period of 60 seconds as the polymerization initiator addition time. Here, the value of T×N was 120. The polymerization was continued at an internal temperature of 70° C. After 5 hours, the polymerization temperature was raised to 80° C., and the heating and stirring were continued for 5 hours to complete polymerization. After the polymerization reaction was completed, residual monomers were evaporated off under reduced pressure, and the resultant mixture was cooled. Thereafter, dilute hydrochloric acid was added therein to dissolve the dispersant calcium phosphate, followed by solid-liquid separation, water washing, filtration and drying to obtain polymerization toner particles (cyan toner particles).

With regard to the toner particles thus obtained, their particle size distribution was measured with Coulter Multisizer to reveal that they had a weight-average particle diameter of 7.0 μm and contained 24% by number of 4.0 μm or smaller diameter particles and 2.0% by volume of 10.1 μm or larger diameter particles, having a small particle diameter and also a very sharp particle size distribution. The content of particles smaller than 2.0 μm diameter was also measured with a flow type particle image analyzer FPIA-1000 to find that it was 25% by number and the fine particles were in a small content.

Cross sections of the above cyan toner particles were observed by TEM to confirm that the release agent ester wax was well encapsulated with (or wrapped in) the shell resin, as shown in FIG. 1.

Any contamination of the polymerizable-monomer composition preparation vessel, granulation vessel and polymerization reaction vessel was examined after the production of the toner particles, where no great contamination was seen. The above process was repeated to carry out continuous 10-batch production to examine the extent of contamination of the vessels, where any scales were seen to have little adhered in all the vessels.

100 parts by weight of the cyan toner particles obtained and 1.0 part by weight of hydrophobic fine titanium oxide powder having a specific surface area of 100 $m^2/g$ as measured by the BET method were blended to obtain a negatively triboelectrically chargeable cyan toner.

With 5 parts by weight of this cyan toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil application mechanism of the fixing assembly was detached), a cyan toner 10,000-sheet continuous paper feed test (running test) was made in a low-temperature low-humidity environment (30° C., 80% RH). Toner's physical properties and results of evaluation are shown in Table 2 [Table 2(A)-2(B)].

Example B-2

Yellow toner particles were obtained in the same manner as in Example B-1 except that the colorant was changed to C.I. Pigment Yellow 180, the Max Blend Blade was replaced with Full-zone Blade (manufactured by Shinko Pantec Co.), the number of revolutions was so adjusted that the number N of pass times per unit time was four times/second and also the polymerization initiator addition time was changed to 200 seconds.

With regard to the toner particles thus obtained, their particle size distribution was measured with Coulter Multisizer to reveal that they had a weight-average particle diameter of 6.8 μm and contained 30% by number of 4.0 μm or smaller diameter particles and 2.2% by volume of 10.1 μm or larger diameter particles, having a small particle diameter and also a very sharp particle size distribution. The content of particles smaller than 2.0 μm in diameter was also measured with a flow type particle image analyzer FPIA-1000 to find that it was 30% by number and the fine particles were in a small content.

Cross sections of the above yellow toner particles were observed by TEM to confirm that the release agent ester wax was well encapsulated with the shell resin as shown in FIG. 1.

Any contamination of the polymerizable-monomer composition preparation vessel, granulation vessel and polymerization reaction vessel was examined after the production of the toner particles, where no great contamination was seen. The above process was repeated to carry out continuous 10-batch production to examine the extent of contamination of the vessels, where any scales were seen to have little adhered in all the vessels.

100 parts by weight of the yellow toner particles obtained and 1.0 part by weight of hydrophobic fine titanium oxide powder having a specific surface area of 100 $m^2/g$ as measured by the BET method were blended to obtain a negatively triboelectrically chargeable yellow toner.

With 5 parts by weight of this yellow toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil application mechanism of the fixing assembly was detached), a yellow toner 10,000-sheet continuous paper feed test (running test) was made in the low-temperature low-humidity environment. Toner's physical properties and results of evaluation are shown in Table 2.

Example B-3

Magenta toner particles were obtained in the same manner as in Example B-1 except that the colorant was changed to C.I. Pigment Red 122, the Max Blend Blade was replaced with an anchor blade, the number of revolutions was so adjusted that the number N of pass times per unit time was once/second, and also the polymerization initiator addition time was changed to 5 seconds.

With regard to the toner particles thus obtained, their particle size distribution was measured with Coulter Multisizer to reveal that they had a weight-average particle diameter of 6.5 μm and contained 33% by number of 4.0 μm or smaller diameter particles and 1.5% by volume of 10.1 μm or larger diameter particles, having a small particle diameter and also a very sharp particle size distribution. The content of particles smaller than 2.0 μm in diameter was also measured with a flow type particle image analyzer FPIA-1000 to find that it was 28% by number and the fine particles were in a small content.

Cross sections of the above magenta toner particles were observed by TEM to confirm that the release agent ester wax was well encapsulated with the shell resin as shown in FIG. 1.

Any contamination of the polymerizable-monomer composition preparation vessel, granulation vessel and polymerization reaction vessel was examined after the production of the toner particles, where no great contamination was seen. The above process was repeated to carry out continuous 8-batch production to examine the extent of contamination of the vessels, where any scales were seen to have little adhered in all the vessels.

100 parts by weight of the magenta toner particles obtained and 1.0 part by weight of hydrophobic fine titanium oxide powder having a specific surface area of 100 $m^2/g$ as measured by the BET method were blended to obtain a negatively triboelectrically chargeable magenta toner.

With 5 parts by weight of this magenta toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil application mechanism of the fixing assembly was detached), a magenta toner 10,000-sheet continuous paper feed test (running test) was made in the low-temperature low-humidity environment. Toner's physical properties and results of evaluation are shown in Table 2.

Example B-4

Black toner particles were obtained in the same manner as in Example B-1 except that the colorant was changed to carbon black, the polymerization initiator addition time was changed to 300 seconds, the stirring blade was replaced with an anchor type stirring blade and its number of revolutions was so adjusted that the number N of pass times per unit time was seven times/second.

With regard to the toner particles thus obtained, their particle size distribution was measured with Coulter Multisizer to reveal that they had a weight-average particle diameter of 7.9 μm and contained 31% by number of 4.0 μm or smaller diameter particles and 2.2% by volume of 10.1 μm or larger diameter particles, having a small particle diameter and also a very sharp particle size distribution. The content of particles smaller than 2.0 μm in diameter was also measured with a flow type particle image analyzer FPIA-1000 to find that it was 37% by number and the fine particles were in a small content.

Cross sections of the above black toner particles were observed by TEM to confirm that the release agent ester wax was well encapsulated with the shell resin as shown in FIG. 1.

100 parts by weight of the black toner particles obtained and 1.5 parts by weight of hydrophobic fine titanium oxide powder having a specific surface area of 100 $m^2/g$ as measured by the BET method were blended to obtain a negatively triboelectrically chargeable black toner.

With 5 parts by weight of this black toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil application mechanism of the fixing assembly was detached), a black toner 10,000-sheet continuous paper feed test (running test) was made in the low-temperature low-humidity environment. Toner's physical properties and results of evaluation are shown in Table 2.

Example B-5

Magnetic toner particles were obtained in the same manner as in Example B-1 except that the colorant was changed to 150 parts by weight of a magnetic material having been subjected to hydrophobic treatment with a silane coupling agent and having an average particle diameter of 0.15 μm and the polymerization initiator addition time was changed to 100 seconds.

With regard to the toner particles thus obtained, their particle size distribution was measured with Coulter Multisizer to reveal that they had a weight-average particle diameter of 6.9 μm and contained 28% by number of 4.0 μm or smaller diameter particles and 1.8% by volume of 10.1 μm or larger diameter particles, having a small particle diameter and also a very sharp particle size distribution. The content of particles smaller than 2.0 μm in diameter was also measured with a flow type particle image analyzer FPIA-1000 to find that it was 26% by number.

Any contamination of the polymerizable-monomer composition preparation vessel, granulation vessel and polymerization reaction vessel was examined after the production of the toner particles, where no great contamination was seen. The above process was repeated to carry out continuous 10-batch production to examine the extent of contamination of the vessels, where any scales were seen to have little adhered in all the vessels.

100 parts by weight of the magnetic toner particles obtained and 1.2 parts by weight of hydrophobic fine titanium oxide powder having a specific surface area of 100 $m^2/g$ as measured by the BET method were blended to obtain a negatively triboelectrically chargeable magnetic toner.

Using this magnetic toner and using the magnetic one-component developing system shown in FIG. 7, a 10,000-sheet continuous paper feed test (running test) was made in the low-temperature low-humidity environment. Toner's physical properties and results of evaluation are shown in Table 2.

Example B-6

Cyan toner particles were obtained in the same manner as in Example B-1 except that the polymerization initiator was changed to t-butyl peroxy-2-ethylhexanoate.

With regard to the toner particles thus obtained, their particle size distribution was measured with Coulter Multisizer to reveal that they had a weight-average particle diameter of 7.1 μm and contained 32% by number of 4.0 μm or smaller diameter particles and 2.0% by volume of 10.1 μm or larger diameter particles, having a small particle diameter and also a very sharp particle size distribution. The content of particles smaller than 2.0 μm in diameter was also measured with a flow type particle image analyzer FPIA-1000 to find that it was 27% by number.

Cross sections of the above cyan toner particles were observed by TEM to confirm that the release agent ester wax was well encapsulated with the shell resin as shown in FIG. 1.

Any contamination of the polymerizable-monomer composition preparation vessel, granulation vessel and polymerization reaction vessel was examined after the production of the toner particles, where no great contamination was seen. The above process was repeated to carry out continuous 10-batch production to examine the extent of contamination of the vessels, where any scales were seen to have little adhered in all the vessels.

100 parts by weight of the cyan toner particles obtained and 2.0 parts by weight of hydrophobic fine titanium oxide powder having a specific surface area of 100 $m^2/g$ as measured by the BET method were blended to obtain a negatively triboelectrically chargeable cyan toner.

With 5 parts by weight of this cyan toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil application mechanism of the fixing assembly was detached), a cyan toner 10,000-sheet continuous paper feed test (running test) was made in the low-temperature low-humidity environment. Toner's physical properties and results of evaluation are shown in Table 2.

Example B-7

Using the toner of Example B-1 and using the non-magnetic one-component developing system as shown in FIG. 4, a 5,000-sheet continuous paper feed test (running test) was made in the low-temperature low-humidity environment. As the result, images with less fog and a stable image density were obtained.

Comparative Example B-1

Cyan toner particles were obtained in the same manner as in Example B-1 except that the polymerization initiator addition time was changed to 2 seconds.

With regard to the toner particles thus obtained, their particle size distribution was measured with Coulter Multisizer to reveal that they had a weight-average particle diameter of 7.1 μm and contained 30% by number of 4.0 μm or smaller diameter particles and 2.2% by volume of 10.1 μm or larger diameter particles, having a small particle diameter and also a very sharp particle size distribution. The content of particles smaller than 2.0 μm diameter was also measured with a flow type particle image analyzer FPIA-1000 to find that it was 33% by number.

Cross sections of the above cyan toner particles were observed by TEM to confirm that the release agent ester wax was well encapsulated with the shell resin as shown in FIG. 1.

Any contamination of the polymerizable-monomer composition preparation vessel, granulation vessel and polymerization reaction vessel was examined after the production of the toner particles, where a great contamination was seen. The above process was repeated to carry out continuous 10-batch production to examine the extent of contamination of the vessels, where scales were seen to have greatly adhered in all the vessels.

100 parts by weight of the cyan toner particles obtained and 1.0 part by weight of hydrophobic fine titanium oxide powder having a specific surface area of 100 $m^2/g$ as measured by the BET method were blended to obtain a negatively triboelectrically chargeable cyan toner.

With 5 parts by weight of this cyan toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil application mechanism of the fixing assembly was detached), a cyan toner 10,000-sheet continuous paper feed test (running test) was made in the low-temperature low-humidity environment. Toner's physical properties and results of evaluation are shown in Table 2.

This toner showed a little high degree of agglomeration, caused fog a little seriously from the initial stage and came to cause the fog greatly with progress of running.

Comparative Example B-2

Yellow toner particles were obtained in the same manner as in Example B-2 except that the polymerization initiator addition time was changed to 600 seconds.

With regard to the toner particles thus obtained, their particle size distribution was measured with Coulter Multisizer to reveal that they had a weight-average particle diameter of 8.3 μm and contained 30% by number of 4.0 μm or smaller diameter particles and 3.3% by volume of 10.1 μm or larger diameter particles, having a little broad particle size distribution. The content of particles smaller than 2.0 μm diameter was also measured with a flow type particle image analyzer FPIA-1000 to find that it was 41% by number.

Any contamination of the polymerizable-monomer composition preparation vessel, granulation vessel and polymerization reaction vessel was examined after the production of the toner particles, where no great contamination was seen.

Cross sections of the above yellow toner particles were observed by TEM to confirm that the release agent ester wax was well encapsulated with the shell resin as shown in FIG. 1.

100 parts by weight of the yellow toner particles obtained and 1.0 part by weight of hydrophobic fine titanium oxide powder having a specific surface area of 100 $m^2/g$ as measured by the BET method were blended to obtain a negatively triboelectrically chargeable yellow toner.

With 5 parts by weight of this yellow toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil application mechanism of the fixing assembly was detached), a yellow toner 10,000-sheet continuous paper feed test (running test) was made in the low-temperature low-humidity environment. Toner's physical properties and results of evaluation are shown in Table 2.

This toner showed a little high degree of agglomeration, caused fog a little seriously from the initial stage and came to cause the fog greatly with progress of running. It also had a little poor fixing performance.

Comparative Example B-3

Cyan toner particles were obtained in the same manner as in Example B-1 except that the stirring blade was replaced with Fullzone Blade (manufactured by Shinko Pantec Co.), the number of revolutions was so adjusted that the number N of pass times per unit time was four times/second and also the polymerization initiator addition time was changed to 3 seconds.

With regard to the toner particles thus obtained, their particle size distribution was measured with Coulter Multisizer to reveal that they had a weight-average particle diameter of 7.1 μm and contained 29% by number of 4.0 μm or smaller diameter particles and 1.8% by volume of 10.1 μm or larger diameter particles, having a small particle diameter and also a very sharp particle size distribution. The content of particles smaller than 2.0 μm diameter was also measured with a flow type particle image analyzer FPIA-1000 to find that it was 32% by number.

Cross sections of the above cyan toner particles were observed by TEM to confirm that the release agent ester wax was well encapsulated with the shell resin as shown in FIG. 1.

Any contamination of the polymerizable-monomer composition preparation vessel, granulation vessel and polymerization reaction vessel was examined after the production of the toner particles, where a great contamination was seen. The above process was repeated to carry out continuous 10-batch production to examine the extent of contamination of the vessels, where scales were seen to have greatly adhered in all the vessels.

100 parts by weight of the cyan toner particles obtained and 1.0 part by weight of hydrophobic fine titanium oxide powder having a specific surface area of 100 $m^2/g$ as measured by the BET method were blended to obtain a negatively triboelectrically chargeable cyan toner.

With 5 parts by weight of this cyan toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil application mechanism of the fixing assembly was detached), a cyan toner 10,000-sheet continuous paper feed test (running test) was made in the low-temperature low-humidity environment. Toner's physical properties and results of evaluation are shown in Table 2.

This toner showed a little high degree of agglomeration, caused fog a little seriously from the initial stage and slightly caused a decrease in image density with progress of running.

Comparative Example B-4

Cyan toner particles were obtained in the same manner as in Example B-1 except that the stirring blade was replaced with Fullzone Blade (manufactured by Shinko Pantec Co.), its number of revolutions was so adjusted that the number N of pass times per unit time was nine point five (9.5) times/second and also the polymerization initiator addition time was changed to 280 seconds.

With regard to the toner particles thus obtained, their particle size distribution was measured with Coulter Multisizer to reveal that they had a weight-average particle diameter of 7.2 μm and contained 35% by number of 4.0 μm or smaller diameter particles and 3.5% by volume of 10.1 μm or larger diameter particles, having a little broad particle size distribution. The content of particles smaller than 2.0 μm diameter was also measured with a flow type particle image analyzer FPIA-1000 to find that it was 42% by number.

Cross sections of the above cyan toner particles were observed by TEM to confirm that the release agent ester wax was well encapsulated with the shell resin as shown in FIG. 1.

Any contamination of the polymerizable-monomer composition preparation vessel, granulation vessel and polymerization reaction vessel was examined after the production of the toner particles, where no great contamination was seen.

100 parts by weight of the cyan toner particles obtained and 1.0 part by weight of hydrophobic fine titanium oxide powder having a specific surface area of 100 $m^2/g$ as measured by the BET method were blended to obtain a negatively triboelectrically chargeable cyan toner.

With 5 parts by weight of this cyan toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil application mechanism of the fixing assembly was detached), a cyan toner 10,000-sheet continuous paper feed test (running test) was made in the low-temperature low-humidity environment. Toner's physical properties and results of evaluation are shown in Table 2.

This toner showed a little high degree of agglomeration, caused fog a little seriously from the initial stage and slightly caused a decrease in image density with progress of running.

Comparative Example B-5

Cyan toner particles were obtained in the same manner as in Example B-1 except that the polymerization initiator was added to the polymerizable-monomer composition. This process was repeated to carry out continuous 10-batch production, where scales were seen to have greatly adhered in the granulation vessel.

Example C-1

An aqueous dispersion medium and a polymerizable-monomer composition were each prepared in the following way.

Preparation of Aqueous Dispersion Medium:

In a vessel having an internal volume of 200 liters, the following components were mixed. The mixture obtained was heated to 68° C. and thereafter stirred at a number of revolutions of 55 r.p.s. by means of a high-speed rotary-shearing stirrer CLEAR MIX CLM-30S (manufactured by M. Technique K.K.).

| | (by weight) |
|---|---|
| Water | 950 parts |
| Aqueous 0.1 mol/liter $Na_3PO_4$ solution | 450 parts |

Next, the inside of the vessel was displaced with nitrogen and at the same time 68 parts by weight of an aqueous 1.0 mol/liter $CaCl_2$ solution was added therein to carry out reaction to obtain an aqueous dispersion medium containing fine particles of calcium phosphate.

Preparation of Polymerizable-monomer Composition:

| | (by weight) |
|---|---|
| Styrene | 150 parts |
| 2-Ethylhexyl acrylate | 20 parts |
| Colorant (C.I. Pigment Yellow 180) | 12 parts |
| Di-t-butylsalicylic acid metal compound | 2 parts |
| Polyester resin (acid value: 5 mg · KOH/g; main peak molecular weight: 7,000) | 15 parts |
| Ester wax (melting point: 65° C.) | 30 parts |
| Divinylbenzene | 0.8 part |

Among the above components, the components other than the ester wax were mixed, and the mixture obtained was dispersed for 3 hours by means of an attritor (manufactured by Mitsui Miike Engineering Corporation), and thereafter the ester wax was added, which were then heated to 68° C. and mixed for 1 hour to obtain a polymerizable-monomer composition.

The number of revolutions of the high-speed rotary-shearing stirrer CLEAR MIX CLM-30S holding therein the aqueous dispersion medium prepared as described above was set at 55 r.p.s., and a solution prepared by dissolving 7 parts by weight of 2,2'-azobis(2,4-dimethylvaleronitrile) as a polymerization initiator in 30 parts by weight of styrene was added over a period of 20 seconds as the polymerization initiator addition time. Here, the value of $T/t_{1/2}$ was $5.5\times 10^{-3}$. On lapse of 5 minutes after the addition of the polymerization initiator was completed, the polymerizable-monomer composition prepared as described above was introduced into the stirrer to start granulation. After the granulation was carried out for 15 minutes, the mixture was moved into a vessel of a stirrer having a propeller stirring blade and, setting its number of revolutions at 0.83 r.p.s., the polymerization was continued at an internal temperature of 68° C. After 6 hours, the polymerization temperature was raised to 80° C., and the heating and stirring were continued for 5 hours to complete polymerization. After the polymerization reaction was completed, residual monomers were evaporated off under reduced pressure, and the resultant mixture was cooled. Thereafter, dilute hydrochloric acid was added therein to dissolve the dispersant calcium phosphate, followed by solid-liquid separation, water washing, filtration and drying to obtain polymerization toner particles (yellow toner particles).

With regard to the toner particles thus obtained, their particle size distribution was measured with Coulter Multisizer to reveal that they had a weight-average particle diameter of 6.0 $\mu$m and contained 30% by number of 4.0 $\mu$m or smaller diameter particles and 1.5% by volume of 10.1 $\mu$m or larger diameter particles, having a small particle diameter and also a very sharp particle size distribution. The content of particles smaller than 2.0 $\mu$m diameter was also measured with a flow type particle image analyzer FPIA-1000 to find that it was 30% by number and the fine particles were in a small content.

Cross sections of the above yellow toner particles were observed by TEM (transmission electron microscopy) to confirm that the release agent ester wax was well encapsulated with the shell resin as shown in FIG. 1.

Any contamination of the polymerizable-monomer composition preparation vessel, granulation vessel and polymerization reaction vessel was examined after the production of the toner particles, where no great contamination was seen. The above process was repeated to carry out continuous 10-batch production to examine the extent of contamination of the vessels, where any scales were seen to have little adhered in all the vessels.

100 parts by weight of the yellow toner particles obtained and 1.5 parts by weight of hydrophobic fine titanium oxide powder having a specific surface area of 100 $m^2/g$ as measured by the BET method were blended to obtain a negatively triboelectrically chargeable yellow toner.

With 5 parts by weight of this yellow toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil application mechanism of the fixing assembly was detached), a yellow toner 10,000-sheet continuous paper feed test (running test) was made in the high-temperature high-humidity environment. Toner's physical properties and results of evaluation are shown in Table 3 [Table 3(A)-3(B)].

Example C-2

Cyan toner particles were obtained in the same manner as in Example C-1 except that the colorant was changed to C.I. Pigment Blue 15:3 and the time at which the polymerizable-monomer composition was introduced was changed to time being on lapse of 8 minutes after the addition of the polymerization initiator was completed.

With regard to the toner particles thus obtained, their particle size distribution was measured with Coulter Multisizer to reveal that they had a weight-average particle diameter of 6.3 μm and contained 29% by number of 4.0 μm or smaller diameter particles and 1.9% by volume of 10.1 μm or larger diameter particles, having a small particle diameter and also a very sharp particle size distribution. The content of particles smaller than 2.0 μm diameter was also measured with a flow type particle image analyzer FPIA-1000 to find that it was 25% by number and the fine particles were in a small content.

Cross sections of the above cyan toner particles were observed by TEM to confirm that the release agent ester wax was well encapsulated with the shell resin as shown in FIG. 1.

Any contamination of the polymerizable-monomer composition preparation vessel, granulation vessel and polymerization reaction vessel was examined after the production of the toner particles, where no great contamination was seen. The above process was repeated to carry out continuous 10-batch production to examine the extent of contamination of the vessels, where any scales were seen to have little adhered in all the vessels.

100 parts by weight of the cyan toner particles obtained and 1.5 parts by weight of hydrophobic fine titanium oxide powder having a specific surface area of 100 $m^2/g$ as measured by the BET method were blended to obtain a negatively triboelectrically chargeable cyan toner.

With 5 parts by weight of this cyan toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil application mechanism of the fixing assembly was detached), a cyan toner 10,000-sheet continuous paper feed test (running test) was made in the high-temperature high-humidity environment. Toner's physical properties and results of evaluation are shown in Table 3.

Example C-3

Magenta toner particles were obtained in the same manner as in Example C-1 except that the colorant was changed to C.I. Pigment Red 122, the polymerization initiator addition time was changed to 30 seconds (here, $T/t_{1/2}=8.0\times10^{-3}$) and the time at which the polymerizable-monomer composition was introduced was changed to time being on lapse of 2 minutes after the addition of the polymerization initiator was completed.

With regard to the toner particles thus obtained, their particle size distribution was measured with Coulter Multisizer to reveal that they had a weight-average particle diameter of 6.0 μm and contained 30% by number of 4.0 μm or smaller diameter particles and 1.4% by volume of 10.1 μm or larger diameter particles, having a small particle diameter and also a very sharp particle size distribution. The content of particles smaller than 2.0 μm diameter was also measured with a flow type particle image analyzer FPIA-1000 to find that it was 34% by number.

Cross sections of the above magenta toner particles were observed by TEM to confirm that the release agent ester wax was well encapsulated with the shell resin as shown in FIG. 1.

Any contamination of the polymerizable-monomer composition preparation vessel, granulation vessel and polymerization reaction vessel was examined after the production of the toner particles, where no great contamination was seen. The above process was repeated to carry out continuous 10-batch production to examine the extent of contamination of the vessels, where scales were seen to have a little adhered in the granulation vessel.

100 parts by weight of the magenta toner particles obtained and 1.5 parts by weight of hydrophobic fine titanium oxide powder having a specific surface area of 100 $m^2/g$ as measured by the BET method were blended to obtain a negatively triboelectrically chargeable magenta toner.

With 5 parts by weight of this magenta toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil application mechanism of the fixing assembly was detached), a magenta toner 10,000-sheet continuous paper feed test (running test) was made in the high-temperature high-humidity environment. Toner's physical properties and results of evaluation are shown in Table 3.

Example C-4

Black toner particles were obtained in the same manner as in Example C-1 except that the temperature each set at the time of preparation of the aqueous dispersion medium, preparation of the polymerizable-monomer composition, granulation and polymerization was changed to 61° C., the colorant was changed to carbon black, the polymerization initiator was changed to 1,1'-azobis(1-acetoxy-1-phenylethane), the polymerization initiator addition time was changed to 2 seconds (here, $T/t_{1/2}=6.0\times10^{-5}$) and the time at which the polymerizable-monomer composition was introduced was changed to time being on lapse of 0.5 minute after the addition of the polymerization initiator was completed.

With regard to the toner particles thus obtained, their particle size distribution was measured with Coulter Multisizer to reveal that they had a weight-average particle diameter of 6.5 μm and contained 30% by number of 4.0 μm or smaller diameter particles and 1.7% by volume of 10.1 μm or larger diameter particles, having a small particle diameter and also a very sharp particle size distribution. The content of particles smaller than 2.0 μm diameter was also measured with a flow type particle image analyzer FPIA-1000 to find that it was 35% by number.

Cross sections of the above black toner particles were observed by TEM to confirm that the release agent ester wax was well encapsulated with the shell resin as shown in FIG. 1.

Any contamination of the polymerizable-monomer composition preparation vessel, granulation vessel and polymerization reaction vessel was examined after the production of the toner particles, where no great contamination was seen. The above process was repeated to carry out continuous 10-batch production to examine the extent of contamination of the vessels, where any scales were seen to have little adhered in all the vessels.

100 parts by weight of the black toner particles obtained and 1.5 parts by weight of hydrophobic fine titanium oxide powder having a specific surface area of 100 $m^2/g$ as measured by the BET method were blended to obtain a negatively triboelectrically chargeable black toner.

With 5 parts by weight of this black toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil application mechanism of the fixing assembly was detached), a black toner 10,000-sheet continuous paper feed test (running test) was made in the high-temperature high-humidity environment. Toner's physical properties and results of evaluation are shown in Table 3.

Example C-5

Magnetic toner particles were obtained in the same manner as in Example C-1 except that the colorant was changed to 140 parts by weight of a magnetic material having been hydrophobic-treated with a silane coupling agent and having an average particle diameter of 0.2 μm and the polymerization initiator addition time was changed to 30 seconds (here, $T/t_{1/2}=8.3\times10^{-3}$).

With regard to the toner particles thus obtained, their particle size distribution was measured with Coulter Multisizer to reveal that they had a weight-average particle diameter of 6.5 μm and contained 25% by number of 4.0 μm or smaller diameter particles and 1.9% by volume of 10.1 μm or larger diameter particles, having a small particle diameter and also a very sharp particle size distribution. The content of particles smaller than 2.0 μm diameter was also measured with a flow type particle image analyzer FPIA-1000 to find that it was 30% by number.

100 parts by weight of the magnetic toner particles obtained and 1.5 parts by weight of hydrophobic fine titanium oxide powder having a specific surface area of 100 $m^2/g$ as measured by the BET method were blended to obtain a negatively triboelectrically chargeable magnetic toner.

Cross sections of the above magnetic toner particles were observed by TEM to confirm that the release agent ester wax was well encapsulated with the shell resin as shown in FIG. 1.

Any contamination of the polymerizable-monomer composition preparation vessel, granulation vessel and polymerization reaction vessel was examined after the production of the toner particles, where no great contamination was seen. The above process was repeated to carry out continuous 10-batch production to examine the extent of contamination of the vessels, where any scales were seen to have little adhered in all the vessels.

Using this magnetic toner and using the magnetic one-component developing system shown in FIG. 7, a 10,000-sheet continuous paper feed test (running test) was made in the high-temperature high-humidity environment. Toner's physical properties and results of evaluation are shown in Table 3.

Example C-6

Yellow toner particles were obtained in the same manner as in Example C-1 except that the polymerization initiator was changed to benzoyl peroxide, the temperature each set at the time of preparation of the aqueous dispersion medium, preparation of the polymerizable-monomer composition, granulation and polymerization was changed to 70° C., and the polymerization initiator addition time was changed to 30 seconds (here, $T/t_{1/2}=5.0\times10^{-4}$).

With regard to the toner particles thus obtained, their particle size distribution was measured with Coulter Multisizer to reveal that they had a weight-average particle diameter of 7.0 μm and contained 25% by number of 4.0 μm or smaller diameter particles and 1.5% by volume of 10.1 μm or larger diameter particles, having a small particle diameter and also a very sharp particle size distribution. The content of particles smaller than 2.0 μm diameter was also measured with a flow type particle image analyzer FPIA-1000 to find that it was 22% by number and the fine particles were in a small content.

Cross sections of the above yellow toner particles were observed by TEM to confirm that the release agent ester wax was well encapsulated with the shell resin as shown in FIG. 1.

Any contamination of the polymerizable-monomer composition preparation vessel, granulation vessel and polymerization reaction vessel was examined after the production of the toner particles, where no great contamination was observable. The above process was repeated to carry out continuous 10-batch production to examine the extent of contamination of the vessels, where any scales were seen to have little adhered in all the vessels.

100 parts by weight of the yellow toner particles obtained and 1.5 parts by weight of hydrophobic fine titanium oxide powder having a specific surface area of 100 $m^2/g$ as measured by the BET method were blended to obtain a negatively triboelectrically chargeable yellow toner.

With 5 parts by weight of this yellow toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil application mechanism of the fixing assembly was detached), a yellow toner 10,000-sheet continuous paper feed test (running test) was made in the high-temperature high-humidity environment. Toner's physical properties and results of evaluation are shown in Table 3.

Example C-7

Using the toner of Example C-1 and using the non-magnetic one-component developing system as shown in FIG. 4, a 5,000-sheet continuous paper feed test (running test) was made in the high-temperature high-humidity environment. As the result, images with less fog and a stable image density were obtained.

Comparative Example C-1

An aqueous dispersion medium and a polymerizable-monomer composition were each prepared in the following way.

Preparation of Aqueous Dispersion Medium:

In a vessel having an internal volume of 200 liters, the following components were mixed. The mixture obtained was heated to 68° C. and thereafter stirred at a number of revolutions of 55 r.p.s. by means of a high-speed rotary-shearing stirrer CLEAR MIX CLM-30S (manufactured by M. Technique K.K.).

| | (by weight) |
|---|---|
| Water | 950 parts |
| Aqueous 0.1 mol/liter $Na_3PO_4$ solution | 450 parts |

Next, the inside of the vessel was displaced with nitrogen and at the same time 68 parts by weight of an aqueous 1.0 mol/liter $CaCl_2$ solution was added therein to carry out reaction to obtain an aqueous dispersion medium containing fine particles of calcium phosphate.

Preparation of Polymerizable-monomer Composition:

| | (by weight) |
|---|---|
| Styrene | 180 parts |
| 2-Ethylhexyl acrylate | 20 parts |
| Colorant (C.I. Pigment Yellow 13) | 12 parts |
| Di-t-butylsalicylic acid metal compound | 2 parts |
| Polyester resin (acid value: 5 mg · KOH/g; main peak molecular weight: 7,000) | 15 parts |
| Ester wax (melting point: 65° C.) | 30 parts |
| Divinylbenzene | 0.8 part |

Among the above components, the components other than the ester wax were mixed, and the mixture obtained was dispersed for 3 hours by means of an attritor (manufactured by Mitsui Miike Engineering Corporation), and thereafter the ester wax was added, which were then heated to 68° C. and mixed for 1 hour to obtain a polymerizable-monomer composition.

The number of revolutions of the high-speed rotary-shearing stirrer CLEAR MIX CLM-30S holding therein the aqueous dispersion medium prepared as described above was set at 55 r.p.s., and a solution prepared by dissolving 7 parts by weight of 2,2'-azobis(2,4-dimethylvaleronitrile) as a polymerization initiator in 30 parts by weight of styrene was added over a period of 20 seconds as the polymerization initiator addition time. Here, the value of $T/t_{1/2}$ was $5.5\times10^{-3}$. On lapse of 15 minutes after the addition of the polymerization initiator was completed, the polymerizable-monomer composition prepared as described above was introduced into the stirrer to start granulation. After the granulation was carried out for 15 minutes, the mixture was moved into a vessel of a stirrer having a propeller stirring blade and, setting its number of revolutions at 0.83 r.p.s., the polymerization was continued at an internal temperature of 68° C. After 6 hours, the polymerization temperature was raised to 80° C., and the heating and stirring were continued for 5 hours to complete polymerization. After the polymerization reaction was completed, residual monomers were evaporated off under reduced pressure, and the resultant mixture was cooled. Thereafter, dilute hydrochloric acid was added therein to dissolve the dispersant calcium phosphate, followed by solid-liquid separation, water washing, filtration and drying to obtain polymerization toner particles (yellow toner particles).

With regard to the toner particles thus obtained, their particle size distribution was measured with Coulter Multisizer to reveal that they had a weight-average particle diameter of 6.6 μm and contained 30% by number of 4.0 μm or smaller diameter particles and 2.0% by volume of 10.1 μm or larger diameter particles, having a small particle diameter and also a very sharp particle size distribution. The content of particles smaller than 2.0 μm diameter was also measured with a flow type particle image analyzer FPIA-1000 to find that it was 29% by number and the fine particles were in a small content.

Cross sections of the above yellow toner particles were observed by TEM (transmission electron microscopy) to confirm that the release agent ester wax was well encapsulated with the shell resin as shown in FIG. 1.

Any contamination of the polymerizable-monomer composition preparation vessel, granulation vessel and polymerization reaction vessel was examined after the production of the toner particles, where a great contamination was seen. The above process was repeated to carry out continuous 10-batch production to examine the extent of contamination of the vessels, where scales were seen to have greatly adhered in all the vessels.

100 parts by weight of the yellow toner particles obtained and 1.5 parts by weight of hydrophobic fine titanium oxide powder having a specific surface area of 100 $m^2/g$ as measured by the BET method were blended to obtain a negatively triboelectrically chargeable yellow toner.

With 5 parts by weight of this yellow toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil-applying mechanism of the fixing assembly was detached), a yellow toner 10,000-sheet continuous paper feed test (running test) was made in the high-temperature high-humidity environment. Toner's physical properties and results of evaluation are shown in Table 3.

Comparative Example C-2

Yellow toner particles were obtained in the same manner as in Example C-1 except that the polymerization initiator was changed to benzoyl peroxide, the temperature each set at the time of preparation of the aqueous dispersion medium, preparation of the polymerizable-monomer composition, granulation and polymerization was changed to 70° C., and the polymerization initiator addition time was changed to 2 seconds (here, $T/t_{1/2}=3.3\times10^{-5}$).

With regard to the toner particles thus obtained, their particle size distribution was measured with Coulter Multisizer to reveal that they had a weight-average particle diameter of 6.8 μm and contained 26% by number of 4.0 μm or smaller diameter particles and 1.5% by volume of 10.1 μm or larger diameter particles, having a small particle diameter and also a very sharp particle size distribution. The content of particles smaller than 2.0 μm diameter was also measured with a flow type particle image analyzer FPIA-1000 to find that it was 24% by number and the fine particles were in a small content.

Cross sections of the above yellow toner particles were observed by TEM to confirm that the release agent ester wax was well encapsulated with the shell resin as shown in FIG. 1.

Any contamination of the polymerizable-monomer composition preparation vessel, granulation vessel and polymerization reaction vessel was examined after the production of the toner particles, where a great contamination was observable. The above process was repeated to carry out continuous 10-batch production to examine the extent of contamination of the vessels, where scales were seen to have greatly adhered in all the vessels.

100 parts by weight of the yellow toner particles obtained and 1.5 parts by weight of hydrophobic fine titanium oxide powder having a specific surface area of 100 $m^2/g$ as measured by the BET method were blended to obtain a negatively triboelectrically chargeable yellow toner.

With 5 parts by weight of this yellow toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil application mechanism of the fixing assembly was detached), a yellow toner 10,000-sheet continuous paper feed test (running test) was made in the high-temperature high-humidity environment. Toner's physical properties and results of evaluation are shown in Table 3.

Comparative Example C-3

Yellow toner particles were obtained in the same manner as in Example C-1 except that the polymerization initiator addition time was changed to 35 seconds (here, $T/t_{1/2}=5.8\times10^{-1}$).

With regard to the toner particles thus obtained, their particle size distribution was measured with Coulter Multisizer to reveal that they had a weight-average particle diameter of 6.2 μm and contained 31% by number of 4.0 μm or smaller diameter particles and 1.5% by volume of 10.1 μm or larger diameter particles, having a small particle diameter and also a very sharp particle size distribution. The content of particles smaller than 2.0 μm diameter was also measured with a flow type particle image analyzer FPIA-1000 to find that it was 34% by number.

Cross sections of the above yellow toner particles were observed by TEM to confirm that the release agent ester wax was well encapsulated with the shell resin as shown in FIG. 1.

Any contamination of the polymerizable-monomer composition preparation vessel, granulation vessel and polymerization reaction vessel was examined after the production of the toner particles, where a great contamination was observable. The above process was repeated to carry out continuous 10-batch production to examine the extent of contamination of the vessels, where scales were seen to have greatly adhered in all the vessels.

100 parts by weight of the yellow toner particles obtained and 1.5 parts by weight of hydrophobic fine titanium oxide powder having a specific surface area of 100 $m^2/g$ as measured by the BET method were blended to obtain a negatively triboelectrically chargeable yellow toner.

With 5 parts by weight of this yellow toner, 95 parts by weight of an acryl-coated ferrite carrier was blended to prepare a developer. Using this developer and a remodeled machine of a commercially available digital full-color copying machine (CLC500, manufactured by CANON INC.) as shown in FIG. 3 (an oil application mechanism of the fixing assembly was detached), a yellow toner 10,000-sheet continuous paper feed test (running test) was made in the high-temperature high-humidity environment. Toner's physical properties and results of evaluation are shown in Table 3.

Evaluation on development, fixing and image quality is made by the methods described below. In all the foregoing Examples and Comparative Examples, the evaluation is made by these methods.

Measurement of quantity of triboelectricity of toner on developing sleeve:

The quantity of triboelectricity of toner on a developing sleeve is determined by the suction type Faraday's gauge method. This suction type Faraday's gauge method is a method in which the outer cylinder of a gauge is pressed against the surface of the developing sleeve and the toner in a certain area on the developing sleeve is sucked to collect it on a filter of its inner cylinder so that the weight of the toner sucked in can be calculated from the weight gain of the filter. At the same time, the quantity of triboelectricity of the toner on the developing sleeve is determined by measuring the quantity of electric charges accumulated in the inner cylinder electrically shielded from the outside.

Image Density:

Image densities at fixed-image areas with a toner weight per unit area of 0.60 $mg/cm^2$ are measured using Macbeth RD918, manufactured by Macbeth Co.

Measurement of Fog:

Fog is measured with REFLECTOMETER MODEL TC-6DS, manufactured by Tokyo Denshoku Co., Ltd., and is calculated according to the following expression. For its measurement on cyan toner images, an amber filter is used. It means that the smaller the value is, the less the fog is.

Fog (%)=[reflectance (%) of standard paper]−[reflectance (%) of non-image area of sample]

A: 1.2% or less.
B: More than 1.2% to 1.6% or less.
C: More than 1.6% to 2.0% or less.
D: More than 2.0.

Fixing Performance & Anti-offset Properties:

The fixing performance and anti-offset properties are evaluated by means of a copying machine having a heat roller external fixing assembly having no oil application mechanism (a remodeled machine of CLC-500, manufactured by CANON INC.).

As materials for the rollers used here, rollers having fluorine resin or rubber surface layers are used in both the upper roller and the lower roller. Rollers each having a roller diameter of about 40 mm are used for both the upper roller and the lower roller. When the transfer medium is, for example, SK paper (available from Nippon Seishi K.K.), fixing is carried out under conditions of a nip of 5.5 mm and a fixing speed of 120 mm/sec under temperature regulation within the temperature range of from 100° C. to 250° C. at intervals of 5° C.

The fixing performance is evaluated on fixing start temperature. To measure the fixing start temperature, solid images printed under temperature conditions not causative of any offset are rubbed twice with Silbon paper (Lens Cleaning Paper "DESPER (R)", trade name; Ozu Paper Co., Ltd.) under application of a load of 50 $g/cm^2$, and the temperature at which the rate of decrease in image density before and after the rubbing is less than 10% is regarded as the fixing start temperature.

Anti-offset properties are evaluated by observing the maximum temperature by which any offset does not occur when temperature is raised on, in other words, the temperature at which the offset occurs (i.e., offset temperature).

Transparency:

Using the above copying machine, images are formed on OHP sheets (CG3300, trade name; available from 3M Co.) in the same manner except that the fixing speed is changed to 35 mm/sec.

Fixed-images with a toner weight per unit area of 0.70 $mg/cm^2$ are formed on the OHP sheets, and their transparency is evaluated on the basis of transmittance measured on such images (i.e., OHP sheet image transmittance).

The transmittance is measured with Shimadzu Automatic Spectrophotometer UV2200 (manufactured by Shimadzu Corporation). Regarding the transmittance of OHP film alone as 100%, measured is transmittance at absorption wavelength of;

in the case of magenta toner: 550 nm;
in the case of cyan toner: 410 nm; and
in the case of yellow toner: 650 nm.

Degree of Agglomeration:

On a vibrating stand of Powder Tester (manufactured by Hosokawa Micron Corporation), 150 μm, 75 μm and 38 μm mesh sieves are overlaid in this order from the top, and thereafter the vibrating stand is so regulated as to vibrate at an amplitude of 0.4 mm. Next, 5 g of the toner is weighed and is gently placed on the 150 μm mesh sieve, positioned uppermost, where the sieves are vibrated for 15 seconds. Thereafter, the weight of the toner that has remained on each sieve is measured to calculate the degree of agglomeration according to the following expression. It follows that, the smaller the value of the degree of agglomeration is, the better fluidity the toner has.

$$\text{Degree of agglomeration (\%)} = \frac{\text{Toner weight (g) on 150 } \mu\text{m mesh sieve}}{5\text{ g}} \times 100 + \frac{\text{Toner weight (g) on 100 } \mu\text{m mesh sieve}}{5\text{ g}} \times 100 \times 3/5 + \frac{\text{Toner weight (g) on 38 } \mu\text{m mesh sieve}}{5\text{ g}} \times 100 \times 1/5$$

TABLE 1(A)

| | Production conditions | | Toner physical properties | | | | | | | |
|---|---|---|---|---|---|---|---|---|---|---|
| | Polymerization initiator addition time | | Molecular weight | | | THF-insoluble matter | FPIA circularity | Weight = average molecular weight | Particles smaller than 2 μm | Degree of agglomeration |
| | (sec.) | T × N | Mp | Mw | Mw/Mn | (%) | | (μm) | (no. %)* | (%) |
| Example: | | | | | | | | | | |
| A-1 | 20 | 30.4 | 21,000 | 200,000 | 9.5 | 50 | 0.96 | 5.9 | 30 | 23 |
| A-2 | 100 | 152 | 22,000 | 230,000 | 10.2 | 45 | 0.97 | 6.2 | 25 | 25 |
| A-3 | 200 | 304 | 21,500 | 240,000 | 10.5 | 53 | 0.96 | 6.0 | 35 | 33 |
| A-4 | 5 | 7.6 | 20,000 | 180,000 | 10.9 | 37 | 0.98 | 6.5 | 37 | 35 |
| A-5 | 30 | 49.1 | 21,000 | 200,000 | 9.7 | 47 | 0.97 | 6.3 | 32 | 27 |
| A-6 | 20 | 30.4 | 22,000 | 210,000 | 10.0 | 52 | 0.97 | 6.1 | 27 | 26 |
| A-7 | 20 | 30.4 | 21,000 | 230,000 | 12.5 | 52 | 0.96 | 6.1 | 31 | 24 |
| A-8 | 20 | 30.4 | 21,000 | 200,000 | 9.8 | 51 | 0.97 | 5.7 | 39 | 34 |
| Comparative Example: | | | | | | | | | | |
| A-1 | 1 | 1.5 | 19,000 | 220,000 | 13.8 | 40 | 0.95 | 6.7 | 29 | 40 |
| A-2 | 360 | 547 | 22,500 | 250,000 | 9.8 | 60 | 0.96 | 6.9 | 42 | 38 |
| A-3 | 280 | 536 | 22,000 | 235,000 | 12.0 | 45 | 0.96 | 6.2 | 40 | 37 |
| A-4 | 4 | 6.1 | 20,000 | 210,000 | 13.0 | 42 | 0.96 | 6.6 | 32 | 37 |
| A-5 | 350 | 443 | 22,000 | 230,000 | 11.5 | 46 | 0.96 | 6.4 | 33 | 36 |

*% by number

TABLE 1(B)

| | Toner evalution | | | Running Test | | | | | |
|---|---|---|---|---|---|---|---|---|---|
| | Fixing | | OHP sheet | Initial Stage | | | After running | | |
| | start temp. (° C.) | Offset temp (° C.) | image transmittance (%) | Quantity of triboelectricity | Fog | Image density | Quantity of triboelectricity | Fog | Image density |
| Example: | | | | | | | | | |
| A-1 | 125 | ≧220 | 75 | −28 | A | 1.48 | −27 | A | 1.49 |
| A-2 | 125 | ≧220 | 72 | −30 | A | 1.52 | −31 | A | 1.51 |
| A-3 | 130 | ≧220 | 68 | −25 | A | 1.49 | −23 | B | 1.50 |
| A-4 | 125 | 210 | — | −24 | A | 1.47 | −22 | B | 1.47 |
| A-5 | 125 | ≧220 | — | −26 | A | 1.50 | −26 | A | 1.50 |
| A-6 | 125 | ≧220 | 74 | −29 | A | 1.49 | −28 | A | 1.50 |
| A-7 | 125 | ≧220 | 74 | −27 | A | 1.49 | −26 | B | 1.48 |
| A-8 | 125 | ≧220 | 73 | −28 | A | 1.48 | −29 | A | 1.43 |
| Comparative Example: | | | | | | | | | |
| A-1 | 125 | 210 | 75 | −28 | B | 1.48 | −25 | C | 1.40 |
| A-2 | 135 | ≧220 | 65 | −27 | B | 1.49 | −20 | C | 1.38 |
| A-3 | 130 | ≧220 | — | −25 | B | 1.50 | −23 | B | 1.39 |
| A-4 | 125 | ≧220 | 75 | −28 | B | 1.48 | −28 | B | 1.41 |
| A-5 | 130 | ≧220 | 74 | −27 | B | 1.49 | −26 | B | 1.44 |

TABLE 2(A)

| | Production conditions | | Toner physical properties | | | | | | |
|---|---|---|---|---|---|---|---|---|---|
| | Polymerization initiator addition time | | Molecular weight | | THF-insoluble matter | FPIA circularity | Weight = average molecular weight | Particles smaller than 2 μm | Degree of agglomeration |
| | (sec.) | T × N | Mp | Mw | (%) | | (μm) | (no. %)* | (%) |
| Example: | | | | | | | | | |
| B-1 | 60 | 120 | 23,000 | 220,000 | 45 | 0.98 | 7.0 | 25 | 26 |
| B-2 | 200 | 800 | 23,500 | 220,000 | 50 | 0.96 | 6.8 | 30 | 28 |
| B-3 | 5 | 5 | 22,500 | 190,000 | 40 | 0.97 | 6.5 | 28 | 38 |
| B-4 | 300 | 2,100 | 23,500 | 240,000 | 55 | 0.95 | 7.9 | 37 | 35 |
| B-5 | 100 | 200 | 23,000 | 225,000 | 47 | 0.97 | 6.9 | 26 | 25 |
| B-6 | 60 | 120 | 22,500 | 225,000 | 46 | 0.98 | 7.1 | 27 | 28 |
| Comparative Example: | | | | | | | | | |
| B-1 | 2 | 4 | 22,000 | 245,000 | 60 | 0.97 | 7.1 | 33 | 45 |
| B-2 | 600 | 2,400 | 23,500 | 230,000 | 54 | 0.94 | 8.3 | 41 | 40 |
| B-3 | 3 | 12 | 22,000 | 225,000 | 52 | 0.97 | 7.1 | 32 | 43 |
| B-4 | 9.5 | 2,660 | 22,500 | 225,000 | 50 | 0.95 | 7.2 | 42 | 44 |

*% by number

TABLE 2(B)

| | Toner evalution | | | Running Test | | | | | |
|---|---|---|---|---|---|---|---|---|---|
| | Fixing | | OHP sheet | Initial Stage | | | After running | | |
| | start temp. (° C.) | Offset temp (° C.) | image transmittance (%) | Quantity of triboelectricity | Fog | Image density | Quantity of triboelectricity | Fog | Image density |
| Example: | | | | | | | | | |
| B-1 | 125 | ≧220 | 73 | −32 | A | 1.49 | −33 | A | 1.50 |
| B-2 | 125 | ≧220 | 70 | −30 | A | 1.50 | −31 | A | 1.50 |
| B-3 | 125 | 210 | 75 | −28 | A | 1.51 | −25 | B | 1.49 |
| B-4 | 130 | ≧220 | — | −29 | A | 1.48 | −26 | B | 1.45 |
| B-5 | 130 | ≧220 | — | −25 | A | 1.50 | −25 | A | 1.50 |
| B-6 | 125 | ≧220 | 72 | −30 | A | 1.51 | −31 | A | 1.50 |
| Comparative Example: | | | | | | | | | |
| B-1 | 125 | ≧220 | 65 | −29 | B | 1.48 | −35 | C | 1.43 |
| B-2 | 130 | ≧220 | 68 | −25 | B | 1.50 | −23 | C | 1.40 |
| B-3 | 125 | ≧220 | 69 | −30 | B | 1.48 | −29 | B | 1.43 |
| B-4 | 125 | ≧220 | 70 | −27 | B | 1.49 | −28 | B | 1.42 |

TABLE 3(A)

| | Production conditions | | Toner physical properites | | | | | | |
|---|---|---|---|---|---|---|---|---|---|
| | Time lapsed until the addition of polymerizable monomer composition *1 | | Molecular weight | | THF-insoluble matter | FPIA circularity | Weight = average molecular weight | Particles smaller than 2 μm | Degree of agglomeration |
| | (min.) | $T/t_{1/2}$ | Mp | Mw | (%) | | (μm) | (no. %)* | (%) |
| Example: | | | | | | | | | |
| C-1 | 5 | $5.5 \times 10^{-3}$ | 21,000 | 200,000 | 45 | 0.96 | 6.0 | 30 | 23 |
| C-2 | 8 | $5.5 \times 10^{-3}$ | 21,000 | 220,000 | 43 | 0.97 | 6.3 | 25 | 22 |
| C-3 | 2 | $8.0 \times 10^{-3}$ | 20,000 | 250,000 | 53 | 0.96 | 6.0 | 34 | 25 |
| C-4 | 0.5 | $6.0 \times 10^{-5}$ | 19,000 | 240,000 | 49 | 0.96 | 6.5 | 35 | 30 |

TABLE 3(A)-continued

| | Production conditions | | Toner physical properites | | | | | | |
|---|---|---|---|---|---|---|---|---|---|
| | Time lapsed until the addition of polymerizable monomer composition *1 | | Molecular weight | | THF-insoluble matter | FPIA circularity | Weight = average molecular weight | Particles smaller than 2 μm | Degree of agglomeration |
| | (min.) | T/t½ | Mp | Mw | (%) | | (μm) | (no. %)* | (%) |
| C-5 | 5 | $8.3 \times 10^{-3}$ | 20,000 | 210,000 | 45 | 0.97 | 6.5 | 30 | 23 |
| C-6 | 5 | $5.0 \times 10^{-4}$ | 21,000 | 210,000 | 45 | 0.96 | 7.0 | 22 | 22 |
| Comparative Example: | | | | | | | | | |
| C-1 | 15 | $5.5 \times 10^{-3}$ | 19,000 | 230,000 | 60 | 0.96 | 6.6 | 29 | 38 |
| C-2 | 5 | $3.3 \times 10^{-5}$ | 20,000 | 260,000 | 55 | 0.96 | 6.8 | 24 | 37 |
| C-3 | 5 | $5.8 \times 10^{-1}$ | 22,000 | 270,000 | 55 | 0.96 | 6.2 | 34 | 38 |

*1 : after the addition of polymerization initiator has been completed.
*% by number

TABLE 3(B)

| | Toner evalution | | | Running Test | | | | | |
|---|---|---|---|---|---|---|---|---|---|
| | Fixing | | OHP sheet | Initial Stage | | | After running | | |
| | start temp. (° C.) | Offset temp (° C.) | image transmittance (%) | Quantity of triboelectricity | Fog | Image density | Quantity of triboelectricity | Fog | Image density |
| Example: | | | | | | | | | |
| C-1 | 125 | ≧220 | 76 | −30 | A | 1.48 | −28 | A | 1.48 |
| C-2 | 125 | ≧220 | 77 | −25 | A | 1.45 | −27 | A | 1.44 |
| C-3 | 130 | 210 | 69 | −26 | A | 1.51 | −26 | B | 1.49 |
| C-4 | 130 | ≧220 | — | −24 | A | 1.48 | −22 | B | 1.46 |
| C-5 | 125 | ≧220 | — | −28 | A | 1.50 | −27 | A | 1.48 |
| C-6 | 125 | ≧220 | 76 | −29 | A | 1.48 | −28 | A | 1.48 |
| Comparative Example: | | | | | | | | | |
| C-1 | 135 | 210 | 63 | −28 | B | 1.48 | −20 | C | 1.43 |
| C-2 | 135 | 210 | 67 | −28 | B | 1.47 | −21 | C | 1.44 |
| C-3 | 135 | 210 | 63 | −27 | B | 1.48 | −20 | C | 1.42 |

What is claimed is:

1. A process for producing a polymerization toner, which comprises preparing a polymerizable-monomer composition which contains at least a polymerizable monomer and a colorant and does not contain any polymerization initiator, introducing the polymerizable-monomer composition into an aqueous medium to start granulation, adding a polymerization initiator to the aqueous medium in the course of the granulation, and then polymerizing the polymerizable-monomer composition having been granulated, to produce toner particles;

said polymerization initiator being added to the aqueous medium over a period of from 5 seconds to 300 seconds, and the time T (second) taken to add the polymerization initiator and the number N of pass times per unit time (times/second) of a stirring blade used in the granulation satisfying the relationship of:

$$3 \leqq T \times N \leqq 500.$$

2. The process for producing a polymerization toner according to claim 1, wherein the time T (second) taken to add the polymerization initiator and the number N of pass times per unit time (times/second) of a stirring blade used in the granulation satisfying the relationship of:

$$8 \leqq T \times N \leqq 250.$$

3. The process for producing a polymerization toner according to claim 1, wherein said polymerization initiator is added to said aqueous medium over a period of from 10 seconds to 250 seconds.

4. The process for producing a polymerization toner according to claim 1, wherein said polymerization initiator is added in the form of a liquid.

5. The process for producing a polymerization toner according to claim 1, wherein a cross-linking agent is incorporated in said polymerizable-monomer composition in an amount of from 0.01 part by weight to 5 parts by weight based on 100 parts by weight of the polymerizable monomer.

6. The process for producing a polymerization toner according to claim 1, wherein said polymerization toner has, in a chromatogram of gel permeation chromatography of tetrahydrofuran-soluble matter, a main-peak molecular weight of from 5,000 to 50,000 and a weight-average molecular weight of from 50,000 to 1,000,000.

7. The process for producing a polymerization toner according to claim 1, wherein said polymerization toner has a tetrahydrofuran-insoluble matter in a content of from 10% by weight to 80% by weight based on the weight of the polymerization toner.

8. The process for producing a polymerization toner according to claim 1, wherein a low-softening substance is incorporated in said polymerizable-monomer composition in an amount of from 1 part by weight to 50 parts by weight based on 100 parts by weight of the polymerizable monomer.

9. The process for producing a polymerization toner according to claim 8, wherein said low-softening substance has a melting point of from 50° C. to 120° C.

10. The process for producing a polymerization toner according to claim 8, wherein said low-softening substance is an ester wax.

11. The process for producing a polymerization toner according to claim 1, wherein a polar resin is incorporated in said polymerizable-monomer composition in an amount of from 0.1 part by weight to 50 parts by weight based on 100 parts by weight of the polymerizable monomer.

12. The process for producing a polymerization toner according to claim 11, wherein said polar resin has an acid value of from 1 mg·KOH/g to 35 mg·KOH/g.

13. The process for producing a polymerization toner according to claim 11, wherein said polar resin has a main peak molecular weight of rom 5,000 to 50,000.

14. The process for producing a polymerization toner according to claim 11, wherein said polar resin is a polyester resin.

15. The process for producing a polymerization toner according to claim 1, wherein said polymerization toner has an average circularity of from 0.95 to 1.00 as measured with a flow type particle image analyzer.

16. The process for producing a polymerization toner according to claim 1, wherein, in said polymerization toner, toner particles having a circle-corresponding diameter smaller than 2.0 $\mu$m as measured with a flow type particle image analyzer are not more than 40% by number.

17. The process for producing a polymerization toner according to claim 1, wherein said polymerization toner has a weight-average molecular weight of from 4 $\mu$m to 10 $\mu$m.

18. The process for producing a polymerization toner according to claim 1, wherein said polymerization initiator is an azo type polymerization initiator.

19. The process for producing a polymerization toner according to claim 1, wherein said polymerization initiator is a peroxide type polymerization initiator.

20. A process for producing a polymerization toner, which comprises preparing a polymerizable-monomer composition which contains at least a polymerizable monomer and a colorant and does not contain any polymerization initiator, introducing the polymerizable-monomer composition into an aqueous medium to effect granulation, adding a polymerization initiator to the aqueous medium after the granulation has been completed, and then polymerizing the polymerizable-monomer composition having been granulated, to produce toner particles;

said polymerization initiator being added to the aqueous medium over a period of from 5 seconds to 300 seconds, and the time T (second) taken to add the polymerization initiator and the number N of pass times per unit time (times/second) of a stirring blade used in the reaction satisfying the relationship of:

$$5 \leqq T \times N \leqq 2{,}500.$$

21. The process for producing a polymerization toner according to claim 20, wherein the time T (second) taken to add the polymerization initiator and the number N of pass times per unit time (times/second) of a stirring blade used in the reaction satisfying the relationship of:

$$10 \leqq T \times N \leqq 2{,}000.$$

22. The process for producing a polymerization toner according to claim 20, wherein said polymerization initiator is added to said aqueous medium over a period of from 10 seconds to 250 seconds.

23. The process for producing a polymerization toner according to claim 20, wherein said polymerization initiator is added in the form of a liquid.

24. The process for producing a polymerization toner according to claim 20, wherein a cross-linking agent is incorporated in said polymerizable-monomer composition in an amount of from 0.01 part by weight to 5 parts by weight based on 100 parts by weight of the polymerizable monomer.

25. The process for producing a polymerization toner according to claim 20, wherein said polymerization toner has, in a chromatogram of gel permeation chromatography of tetrahydrofuran-soluble matter, a main-peak molecular weight of from 5,000 to 50,000 and a weight-average molecular weight of from 50,000 to 1,000,000.

26. The process for producing a polymerization toner according to claim 20, wherein said polymerization toner has a tetrahydrofuran-insoluble matter in a content of from 10% by weight to 80% by weight based on the weight of the polymerization toner.

27. The process for producing a polymerization toner according to claim 20, wherein a low-softening substance is incorporated in said polymerizable-monomer composition in an amount of from 1 part by weight to 50 parts by weight based on 100 parts by weight of the polymerizable monomer.

28. The process for producing a polymerization toner according to claim 27, wherein said low-softening substance has a melting point of from 50° C. to 120° C.

29. The process for producing a polymerization toner according to claim 27, wherein said low-softening substance is an ester wax.

30. The process for producing a polymerization toner according to claim 20, wherein a polar resin is incorporated in said polymerizable-monomer composition in an amount of from 0.1 part by weight to 50 parts by weight based on 100 parts by weight of the polymerizable monomer.

31. The process for producing a polymerization toner according to claim 30, wherein said polar resin has an acid value of from 1 mg·KOH/g to 35 mg·KOH/g.

32. The process for producing a polymerization toner according to claim 30, wherein said polar resin has a main peak molecular weight of rom 5,000 to 50,000.

33. The process for producing a polymerization toner according to claim 30, wherein said polar resin is a polyester resin.

34. The process for producing a polymerization toner according to claim 20, wherein said polymerization toner has an average circularity of from 0.95 to 1.00 as measured with a flow type particle image analyzer.

35. The process for producing a polymerization toner according to claim 20, wherein, in said polymerization toner, toner particles having a circle-corresponding diameter smaller than 2.0 $\mu$m as measured with a flow type particle image analyzer are not more than 40% by number.

36. The process for producing a polymerization toner according to claim 20, wherein said polymerization toner has a weight-average molecular weight of from 4 $\mu$m to 10 $\mu$m.

37. The process for producing a polymerization toner according to claim 20, wherein said polymerization initiator is an azo type polymerization initiator.

38. The process for producing a polymerization toner according to claim 20, wherein said polymerization initiator is a peroxide type polymerization initiator.

39. A process for producing a polymerization toner, which comprises:

preparing a polymerizable-monomer composition which contains at least a polymerizable monomer and a colorant and does not contain any polymerization initiator, adding a polymerization initiator to an aqueous medium, introducing the polymerizable-monomer composition into the aqueous medium to effect granulation, and then polymerizing the polymerizable-monomer composition having been granulated, to produce toner particles;

said polymerizable-monomer composition being introduced into the aqueous medium within 10 minutes after the polymerization initiator has been added, and the time T (second) taken to add the polymerization initiator being:

$$5.0\times10^{-5}\leqq T/t_{1/2}\leqq1.0\times10^{-2}$$

where $t_{1/2}$ is the half-life period of the polymerization initiator at granulation temperature.

40. The process for producing a polymerization toner according to claim 39, wherein said polymerizable-monomer composition is introduced into the aqueous medium at a time of from 1 minute to 8 minutes after the addition of said polymerization initiator has been completed.

41. The process for producing a polymerization toner according to claim 39, wherein the time T (second) taken to add the polymerization initiator is:

$$1.0\times10^{-4}\leqq T/t_{1/2}\leqq1.0\times10^{-2}.$$

where $t_{1/2}$ is the half-life period of the polymerization initiator at granulation temperature.

42. The process for producing a polymerization toner according to claim 39, wherein said polymerization initiator is added in the form of a liquid.

43. The process for producing a polymerization toner according to claim 39, wherein a cross-linking agent is incorporated in said polymerizable-monomer composition in an amount of from 0.01 part by weight to 5 parts by weight based on 100 parts by weight of the polymerizable monomer.

44. The process for producing a polymerization toner according to claim 39, wherein said polymerization toner has, in a chromatogram of gel permeation chromatography of tetrahydrofuran-soluble matter, a main-peak molecular weight of from 5,000 to 50,000 and a weight-average molecular weight of from 50,000 to 1,000,000.

45. The process for producing a polymerization toner according to claim 39, wherein said polymerization toner has a tetrahydrofuran-insoluble matter in a content of from 10% by weight to 80% by weight based on the weight of the polymerization toner.

46. The process for producing a polymerization toner according to claim 39, wherein a low-softening substance is incorporated in said polymerizable-monomer composition in an amount of from 1 part by weight to 50 parts by weight based on 100 parts by weight of the polymerizable monomer.

47. The process for producing a polymerization toner according to claim 46, wherein said low-softening substance has a melting point of from 50° C. to 120° C.

48. The process for producing a polymerization toner according to claim 46, wherein said low-softening substance is an ester wax.

49. The process for producing a polymerization toner according to claim 39, wherein a polar resin is incorporated in said polymerizable-monomer composition in an amount of from 0.1 part by weight to 50 parts by weight based on 100 parts by weight of the polymerizable monomer.

50. The process for producing a polymerization toner according to claim 49, wherein said polar resin has an acid value of from 1 mg·KOH/g to 35 mg·KOH/g.

51. The process for producing a polymerization toner according to claim 49, wherein said polar resin has a main peak molecular weight of rom 5,000 to 50,000.

52. The process for producing a polymerization toner according to claim 49, wherein said polar resin is a polyester resin.

53. The process for producing a polymerization toner according to claim 39, wherein said polymerization toner has an average circularity of from 0.95 to 1.00 as measured with a flow type particle image analyzer.

54. The process for producing a polymerization toner according to claim 39, wherein, in said polymerization toner, toner particles having a circle-corresponding diameter smaller than 2.0 $\mu$m as measured with a flow type particle image analyzer are not more than 40% by number.

55. The process for producing a polymerization toner according to claim 39, wherein said polymerization toner has a weight-average molecular weight of from 4 $\mu$m to 10 $\mu$m.

56. The process for producing a polymerization toner according to claim 39, wherein said polymerization initiator is an azo type polymerization initiator.

57. The process for producing a polymerization toner according to claim 39, wherein said polymerization initiator is a peroxide type polymerization initiator.

* * * * *